United States Patent [19]

Bhalaik et al.

[11] Patent Number: 4,695,194

[45] Date of Patent: Sep. 22, 1987

[54] MOBILE MARINE OPERATIONS STRUCTURE

[75] Inventors: Arun Bhalaik, Seattle, Wash.; Peter W. Braddick, Fullerton, Calif.; Darryl S. Brittin, Laguna Hills, Calif.; Gerald L. Johnson, Orange, Calif.

[73] Assignee: Santa Fe International Corporation, Alhambra, Calif.

[21] Appl. No.: 945,514

[22] Filed: Dec. 23, 1986

Related U.S. Application Data

[62] Division of Ser. No. 819,288, Jan. 16, 1986.

[51] Int. Cl.[4] ..... E02B 17/00

[52] U.S. Cl. ..... 405/207; 405/209; 405/217; 405/226

[58] Field of Search ..... 405/195, 203, 205, 207, 405/209, 211, 217, 226

[56] References Cited

U.S. PATENT DOCUMENTS

| | | | |
|---|---|---|---|
| 4,094,162 | 6/1978 | Allee | 405/207 X |
| 4,479,742 | 10/1984 | Bruce | 405/217 |
| 4,511,288 | 4/1985 | Wetmore | 405/217 |
| 4,512,684 | 4/1985 | Hale et al. | 405/217 |

*Primary Examiner*—David H. Corbin

*Attorney, Agent, or Firm*—Harris, Kern, Wallen & Tinsley

[57] ABSTRACT

A marine operations structure for use in arctic seas having steel/concrete composite ice walls positioned to permit multi-year ice ridges to be broken up with lower vertical forces imposed on the structure than heretofore possible. The structure provides for simultaneous contacting and fracturing of both surface ice floe and multi-year ice ridges by proportioning of the ratio of the annular dimension of a first sloped surface to the radius of the structure within the range of about from 0.15 to 0.30. The structure is fabricated by modular construction techniques which lowers total construction costs. The structure is in the form of a sixteen-sided polygonal sloped walled marine structure with internal ballast tanks for providing gravity founding of the structure on the sea floor. Modular drilling equipment is provided for and supported by the structure for use through two rectangular shaped moon pools extending vertical throughout the central core of the structure. The process for simultaneously contacting and fracturing surface ice floes and ice pressure ridges is set forth along with the processes of installing and deballasting and relocating the structure. Also the process of fabricating the marine operations structure is set forth.

10 Claims, 39 Drawing Figures

FIG. 10
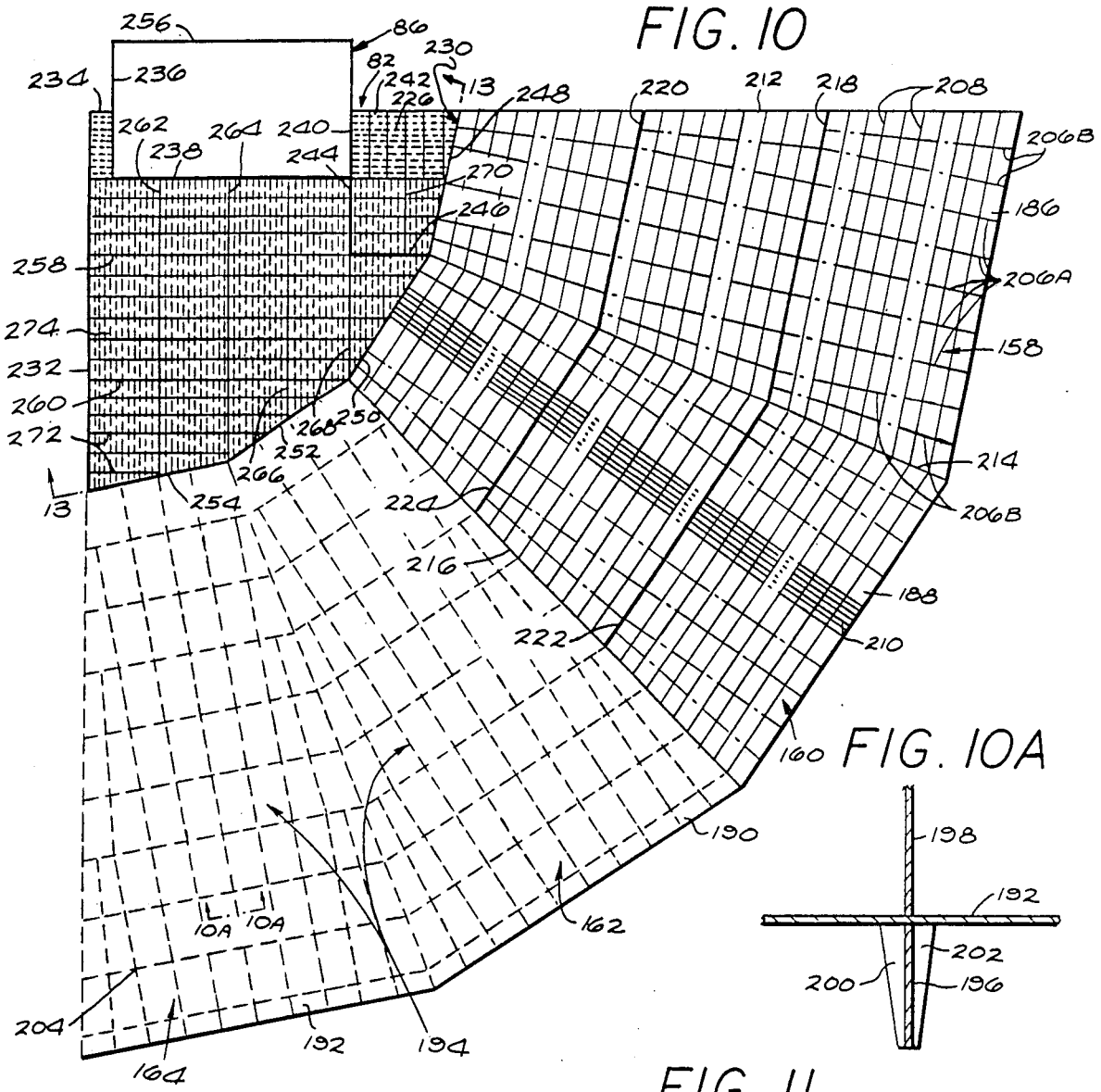
FIG. 10A
FIG. 10B
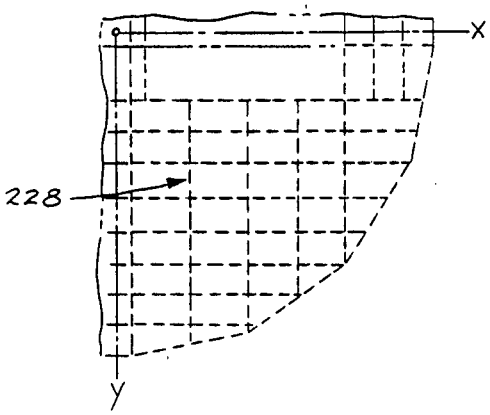
FIG. 11
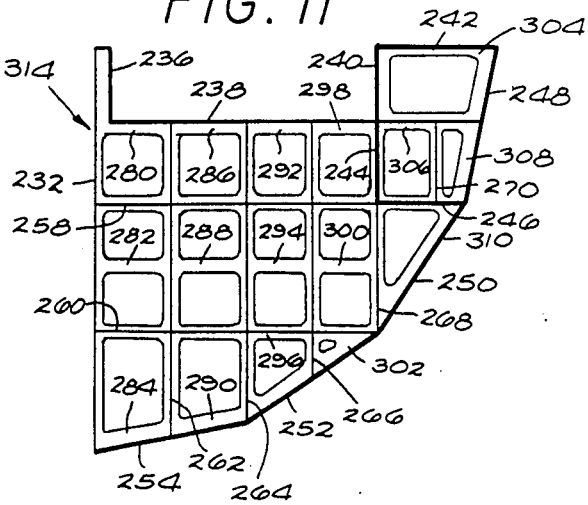

ELEV. 21.5M

ELEV. 38.5M

FIG. 29
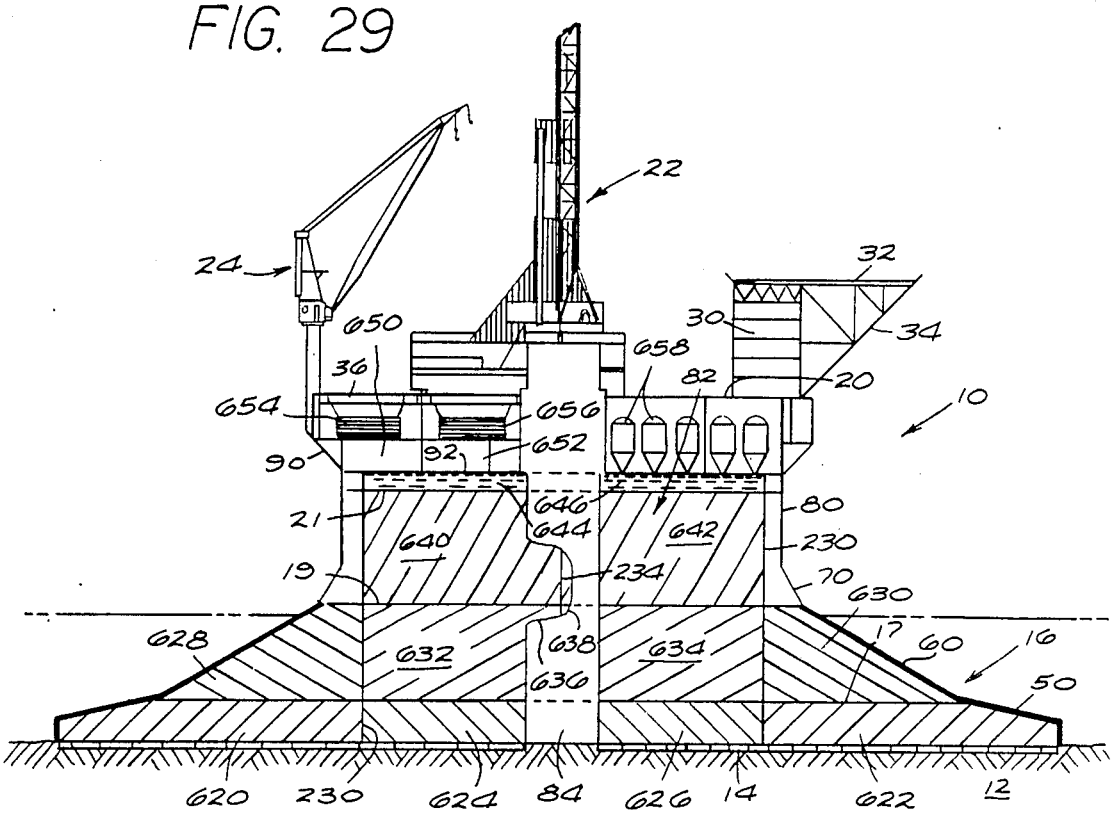
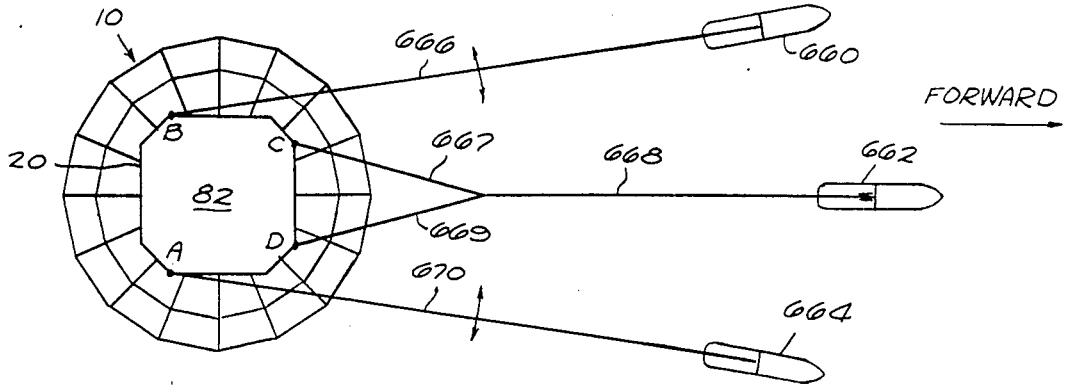
FIG. 30

FIG. 31
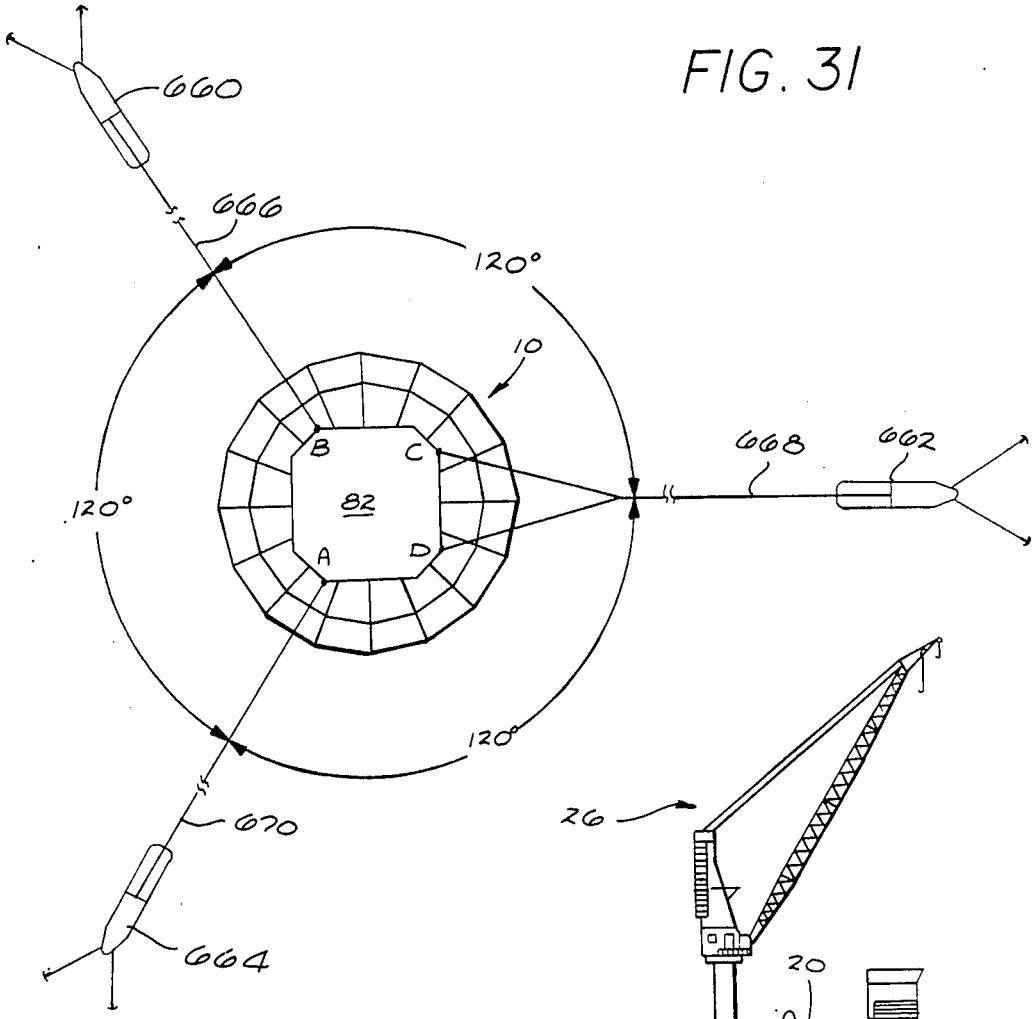
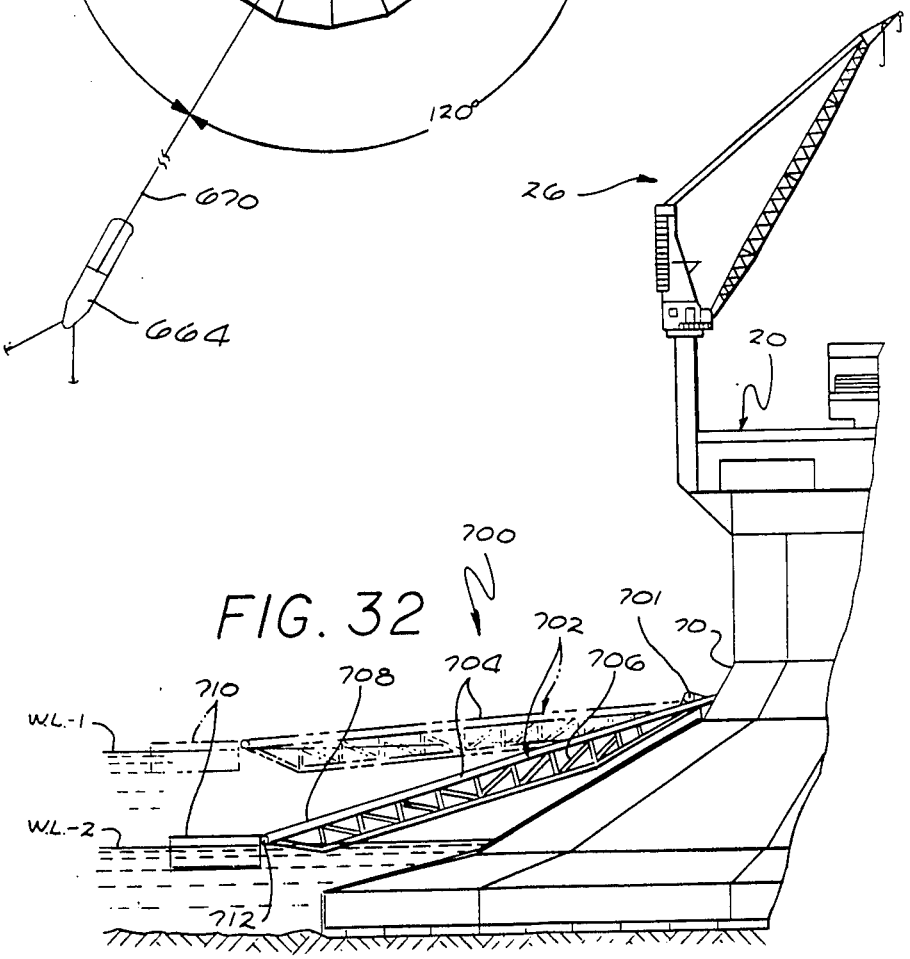
FIG. 32

MOBILE MARINE OPERATIONS STRUCTURE

This application is a division of application Ser. No. 819,288, filed Jan. 16, 1986.

TECHNICAL FIELD

This invention relates to an improved offshore marine structure suitable for use in the polar seas. More particularly, this invention relates to a mobile offshore gravity structure having sloped surfaces for breaking up ice features which impinge upon the structure and having features which then enable long-term use at selected sites. While the word "arctic" is most often used herein, it should be understood that the invention is suitable for use in all polar areas and is not to be limited to the specific areas mentioned.

BACKGROUND OF THE INVENTION

In the offshore oil industry a variety of ship-shaped vessels, semi-submersible vessels, barges, and bottom-supported gravity contact platforms are utilized for oil exploration and development drilling. Production platforms are usually secured to the sea floor by pilings and are thus permanent structures. In the offshore polar seas the environmental conditions are too hostile for much of the year for surface floating vessels and barges due to the existence and movement of ice features.

It has, therefore, been regarded as necessary to utilize mobile structures which can be positioned over particular drilling and/or production sites and can then be submerged into bottom-supported gravity contact with the sea floor. Such structures must then remain functional for their intended uses even when large ice features impinge on the outer surfaces. Ice features such as multi-year ridges embedded in multi-year floes can apply sufficient force so as to actually cause movement of some such structures from their established locations.

When drilling activities are to be carried out in benign sea areas, a wide variety of platform configurations and erection techniques can be employed since low wave heights and ice-free weather conditions prevail. The gravity contact platform structures utilized in polar seas can also be used in such areas such as those encountered in the polar latitudes.

For oil drilling and production in arctic conditions, such as those encountered in the Beaufort Sea, the Chuckchi Sea, or the Bering Sea, specialized structural designs must be employed. In many parts of the arctic latitudes, the seas are generally covered with ice from October through June. A land fast ice cover begins to form early in October and grows seaward during the winter and spring, reaching a maximum thickness of approximately 7 feet by May. Break-up usually begins in early June and continues throughout the remainder of the summer. This land fast ice consists of two distinct zones. The first zone extends outwardly from the sore to a water depth of about 33 feet. This zone consists of smooth first-year ice with thickness up to approximately 7 feet. The second zone covers a water depth range of 33 feet to about 66 feet and contains a number of first year pressure ridges. These pressure ridges are formed by break-up of a fault line and collision through movement of two ice floes toward the fault line position from opposite directions. This action then produces ice rubble which remelts and freezes to produce a pressure ridge of ice. Ice floes in the second zone move forward with wind and water currents and can impose very high impact forces on any stationary structure.

First year ice ridges which survive the summer period evolve into multi-year ice ridges which are more consolidated than first-year ridges. Both first-year ridges and multi-year ridges are found in the second zone.

Beyond the second zone and out to a position just past the continential Shelf, at water depths exeeding 200 feet, is the transition zone which contains large pressure ridges that move around in sporadic fashion. Beyond this zone is the permanent polar ice pack which is composed primarily of multi-year ice. This description of ice conditions holds particularly for the south part of the Beaufort Sea between Harrison Bay and Prodhue Bay.

Another environmental condition encountered in the Beaufort Sea area is that the sea floor consists mainly of pleistocene clays and holocene silts which have low force-bearing properties. As a result of this soft sea floor, some oil production equipment such as the well cap valve and tube systems known as "Christmas Trees" have been known to sink into and disappear in the silt unless adequately buoyed.

The combination of ice floes on the surface of the sea and soft, low force-bearing, sea floor soil conditions presents special problems for polar offshore structure design and operations. The first problem is that the ice floes impact any support member extending through the water surface and this, in turn, tends to push the entire platform off of its drilling location.

The force of large ice features has been found to be sufficient to move a large multi-ton platform. Due to the soft sea floor soil conditions, such platforms cannot be adequately secured to the sea floor by piles or other economically feasibly means.

One type of structure which has evolved for such conditions is shown in U.S. Pat. No. 4,080,796 to Edling et al. Three circular cross-section columns, are utilized to support the drilling platform above a buried mat. When the migrating ice features encounter such circular cross-section columns, the ice floe fails by crushing, buckling, and shearing of the impacting ice feature. The compressive or crushing strength of sea ice depends upon its structure, temperature, confinement, brine volume, strain-rate, and any flaws present; and generally ranges from about 200 to 1500 pounds per square inch. A structure of the type shown in this patent may be able to successfully resist the lateral forces imposed by first-year sheet ice and first-year pressure ridges in the first and second zones.

A problem of another order of magnitude however, is encountered when a large multi-year floe or multi-year ridge embedded in a multi-year floe impacts one or two of the support columns shown in U.S. Pat. No. 4,080,796. The resulting lateral force imposed on the structure is sufficient to move it off station and even to tilt it, particularly in view of the off-center placement of the drilling derrick. U.S. Pat. No. 4,314,776 to Palmer et al. also shows a structure designed to break surface ice floes by crushing and shearing fracturing.

It is also possible to utilize a third type of ice failure in order to break the ice features encountered in hostile actic environments. By configuring the structure to force the multi-year ice floe and multi-year ice ridge to bend upwardly away from the horizontal flotation plane, it is possible to fracture the floe and ice ridge by out-of-plane bending failure. Such a failure mode imposes large vertical forces on the portion of the structure which forces the multi-year ice ridge to move upwardly out of its flotation plane. While such out-of-plane bending or flexural failure results in flexural stress in the ice, the flexural strength is only about 80 to 130 pounds per square inch.

The large sizes of the multi-year ice ridges embedded in multi-year floes also impose horizontal forces on the structures in the 30,000 kips to about 200,000 kips range (1 kip=1,000 lbs.) These multi-year ridges have been the subject of considerable investigation in recent years. A typical large ridge may have a length of several thousand feet, a width of 335 feet, a total depth at the midpoint from sail to bottom of the keel of 85 feet, and be embedded in a multi-year ice floe having a thickness of up to about 28 feet. The keel width in the direction perpendicular to the ridge length is about 110 feet. The angle from the bottom of the keel to the bottom of the multi-year ice floe varies substantially and averages about 30 degrees.

In order to effect the break-up of such large ice features, a number of bottom-supported gravity contact structures have been evolved. The simplest forms of these structures are those having a single sloped surface to promote out-of-plane bending failure of large ice features such as shown in U.S. Pat. No. 3,952,527 to Vinieratos et al. Another structure of this type is shown in U.S. Pat. No. 3,793,840 to Mott et al.

Yet another type of structure is the multiple-surface type such as shown in U.K. Pat. Nos. 2,017,793, 2,017,794 and 2,018,700. In these structures a wide flange with an angle of about 15° to the horizontal plane forms the base of the structure. A second sloped surface is positioned close into the center of the structure for effecting the crushing break-up of surface ice floes. In such structures the waterline diameter is kept as small as possible to reduce the total ice forces loading. The relative proportions of the base flange annular width compared to the structure total radius results in the multi-year ice ridges being fractured by out-of-plane bending independently of the break-up of the surface ice floe. The vertical forces imposed on structures if this configuration by such out-of-plane bending fracturing of pressure ice ridges are in the range of 50,000 to 200,000 kips.

U.S. Pat. No. 4,325,655 to Jahns et al. shows structures similar to the above U.K. patents in FIGS. 2–4. Other modifications which present the same ice fracturing mechanics are also set forth in which the fracturing of surface ice floes occurs separately from the break-up of the multi-year pressure ridges. Such separate fracturing mechanics are due to the relative proportioning of the ice imparting surfaces. The ratio of the lesser sloped wall section annular width to total structure radius varies from 0.35 to 0.7 in U.S. Pat. No. 4,325,644. This proportioning insures that the surface ice floes will be fractured separately from the pressure ridge fracturing which will, in turn, tend to reduce the peak ice loading on the structure. The ice impact walls are constructed of steel plate which is subject to permanent deformation at the ice loading conditions encountered. Such deformation is due to the malleability of the steel plate employed.

It is recognized in this art that the largest vertical forces imposed on the sloping surface structures occur just prior to the fracturing of the multi-year ice ridged.

Another factor in the constitution of these structures is that the sloped ice contacting flange must be supported by internal reinforcements in order to withstand the high impact force loads. When a steel-only fabrication design is used for these structures, engineering calculations show that the internal reinforcements have to be so closely spaced together that it is very difficult to perform the necessary welding to secure the reinforcements required.

U.S. Pat. No. 4,080,798 to Reusswig et al. shows a single sloping surface, bottom-resting drilling island which combats the ice floe problems by providing circulated heating fluids in the ice walls. U.S. Pat. No. 4,265,569 to Gefrert shows a structure having steeply sloping surfaces with a 45° angle on the lower surface and a 60° angle on the upper surface, and proposes to solve the ice impact problems by means of a heating source similar to that of the U.S. Pat. No. 4,080,798.

Thus, the multi-sloped arctic structures are characterized by sloped bottom flanges which extend inwardly for a large percentage of the radius of the overall structure and thus are the only part of the structure which is effective for causing bending fracturing of multi-year ice ridges. Another characteristic of these structures is that the ice contacting surfaces of both the base flange and the second sloping surfaces are fabricated by steel plate which then necessitates the use of reinforcements which cannot be economically constructed.

Another problem with the above described multi-sloped offshore construction is that these structures are all installed on the sea bottom without regard to the depth in which they are installed. There is no provision for elevating the structures above the sea floor in order to maintain the ice floe contacting level at a nearly equivalent vertical position independently of the water depth. The problem encountered is that placement of such structures in 40 foot depths encounters significantly different ice break-up mechanics than those encountered in 80 feet of water since the ice features then contact the sloped surfaces located at higher vertical positions on the structure. Other problems with these structures are that the on-loading and off-loading is rendered difficult since there is no water surface loading capacity. Another problem is that controlled positioning of the structures during installation is not provided for and hence tilt over and/or horizontal final resting positions can occur during installation.

Part of the above problems evolve from the mechanics of ice feature break-up by fixed structures. Surface ice floes are anistotropic and fracture through the modes of crushing, buckling, shearing and bending. The latter mode operates to extend fracture places radially outward from the fixed structure. Such planes weaken the ice floe and will continue to propagate through a given floe sheet when it collides with a vertical or near-vertical wall of the structure. This surface floe break-up then produce ice floe "ride-up" on the structure which can result in large ice loading forces of about 30 to 40 percent of the total ice load. This ice "ride-up" problem has resulted in marine engineers reducing the waterline diameters of the structure so that less ice rubble accumulates.

Another type of problem is encountered by the prior art structures when multi-year ice ridges embedded in multi-year floes are encountered. These large ice ridges come in contact with the structures far from the position of the sloped surface which penetrates the water and thus breaks up surface ice floes. The ice ridge is then wedged upon the incline plane of the first sloped surface and its entire prefracturing weight is taken up by the structure. Both vertical and horizontal forces are imposed on the structures during this impact. The ratio of the horizontal force to the vertical force depends upon the slope of the ice wall and the coefficient of friction at the ice/structure interface. The ratio decreases as the slope decreases and as the coefficient of friction decreases.

Ice ridges can be fractured more easily by out-of-plane vertical bending due to their geometry and strength characteristics. During the fracturing and clearing process a central and two outlying hinges are formed in the ridge. The large vertical forces of 50,000 to 200,000 kips encountered in this process can drive the structure base flange into the soft sea bottom. The opposite side of the structure base then breaks loose from the bottom and the structure can slide or come to rest at a tilting angle. Such displacement problems are severe when drilling an oil well.

The provision for fracturing large ice features with lower vertical forces and lower horizontal forces imposed upon the structure would be a large step forward in the offshore industry.

SUMMARY OF THE INVENTION

The marine operations structure of the present invention is provided with features to permit installation at and removal from various sites. The structure is characterized by ice wall proportions, positioning, and construction features which combine to permit multi-year ice features comprised of multi-year ice ridges embedded in multi-year floes to be broken up with lower horizontal forces than has been the case with prior structures with vertical ice walls, and with lower horizontal and vertical forces than prior structures with sloping ice walls.

In overall configuration the structure has a base flange with a narrow annular width positioned a considerable distance from the structure centerline. The supper surface of the base flange forms a first sloped ice wall surface. A second sloped ice wall is positioned above the first ice wall for contacting surface ice floes at the operating depth of the structure. Adjustment of the foundation height of the structure is achieved by the combination of the structure with a base berm.

Within a second sloped surface a central core is formed with two rectangular moon pools capable of providing for 18 drill holes within each moon pool. Two drilling assemblies are mounted for movement over the moon pools in the horizontal plane.

Within the mobile structure a series of ballast and storage tanks are provided by the use of vertical watertight bulkheads and horizontal flats. Additional structural support is provided by the use of swash bulkheads.

A multi-deck operational platform is secured to the upper part of the central core.

The narrow base flange first sloped surface is positioned to encounter a multi-year ice ridge at the same time that the edge of the multi-year floe in which the ice ridge is embedded is in fracturing contact with the upper second sloped surface. In this manner, the fracture propagation due to the fracture planes extending radially from the second surface is extended and completed by contact of the ice ridge with the underlying first sloped surface. Through the simultaneous contacting of the multi-year ice features with both the first and second sloped surfaces these ice features are out-of-plane bent and fractured with lower imposed vertical forces on the structure than would occur if only separate fracturing contact with the first sloped surface of the structure occurred.

The simultaneous contacting and fracturing of a multi-year ice feature consisting of a multi-year ridge in a multi-year floe with both first and second sloped surfaces is provided by the proportioning of the annular dimension of the first sloped surface when measured in a horizontal plane with respect to the radius of the structure. The proportioning of this ratio can be from 0.15 to 0.30. It has been found that ratios larger than the upper limit specified by this range result in the multi-year ice ridge being out-of-plane bent and fractured on the first surface without the benefit of the fracture propagation occurring from the bending fracturing caused by the second surface. Such second surface propagation results in weakened vertical planes being propagated out into in the ice pressure ridges from the structure so that the out-of-plane bending in the ice ridge occurs with lower vertical force loads being imposed on the structure.

A ratios larger than 0.30, the dimension of the sloped first surface is so far spaced from the second surface contact with the waterline that fracture propagation through the surface ice flow may not appreciably penetrate into the mass of the multi-year ice ridge. Hence, in the present invention the base flange sloped surface is of narrow proportion compared to the overall structure radius to assure that the fracture propagation will aid in the formation of the out-of-plane central hinge which must be created in the multi-year ice ridge.

The steel/concrete composite ice walls are constructed as described herein and are reinforced with a series of vertically positioned watertight and swash bulkheads extending radially from the central core of the structure. Also, a series of circumferentially arranged swashed web frames are utilized to provide transverse structural strength between the bulkheads. Internal girders and stiffeners are also employed to achieve adequate reinforcement for providing a sequential force distribution feature for the composite ice walls. Ice walls constructed as herein disclosed are not subject to permanent bending deformation as are steel plate ice walls. The steel/concrete composite ice walls have high resistance to shear, puncture, and crushing forces imposed by the multi-year ice ridges. In addition, the walls will permit far less heat transfer through them than ice walls of steel plate only and also less than sandwich ice walls of steel-concrete-steel construction. The ice walls are orthotropic because of orientation of the steel members in them. These ice walls resist vertical forces from ice ridges in the range of about from 100,000 to 200,000 kips without significant deformation.

The base of the structure is provided with a cross grid pattern of skirts with sink into the soft subsea soil and provide more stable foundation for the structure to resist the large horizontal forces imposed by the break-up of multi-year ice features.

Ballast tanks are provided within the structure above the sea level to increase the founding pressure of the structure on the subsea soil. Also, a floating ramp/dock is provided for loading and unloading on the structure.

The steel/concrete composite ice wall is constructed of normal weight concrete of from about 130 to 180 pounds per cubic foot which has excellent abrasion properties against the moving ice features.

The horizonal cross-section of the structure can be a polygonal with 8 to 24 or more sides. A 16-sided polygon is preferred.

The slope angle for the base flange is from 8° to 25°. The slope of the second ice wall is from 25° to 45°.

The described structure presents a number of advantageous construction features such as the use of slip-forming when constructing the ice walls. Repetitive sectional construction is employed to permit modularized fabrication economics. Modular segments for the sixteeh truncated pie-shaped sections in the structure are fabricated to significantly lower construction costs. The reinforcing superstructure which supports the two ice walls has sufficiently wide spacing to facilitate welding during construction.

Any voids or defects in the concrete construction of the steel/concrete composite ice wall are readily detected upon removal of the slip forms. A sandwich ice wall of steel-concrete-steel construction does not provide for this ready detection of voids or defects in the concrete construction.

The marine structure has sufficiently buoyant capacity to maintain the entire structure with the supported drilling platform in a floating condition to permit towing. Ballast means including storage tanks and pump equipment are provided for ballasting the structure to decrease the buoyancy to enable lowering of the structure in a controlled manner onto the sea floor. Deballasting means are also provided for enabling the structure to be refloated.

It is therefore, an object of the present invention to provide a marine operations structure in which the proportioning of a first sloped surface to the overall structure radius will provide for the simultaneous contacting of multi-year ice features consisting of multi-year ridges embedded in multi-year floes with both the first and a second sloped surface in order to enable out-of-plane bending and fracturing of the multi-year ice features.

Another object of the present invention is to provide a marine operations structure in which a steel/concrete composite ice wall is employed in order to provide sequential force distribution during contact with multi-year ridges.

Another object is to provide a marine operations structure having a horizontal cross-section base of polygonal shape which includes first and second ice impacting slopes.

Yet another object of the present invention is to provide a marine operations structure which comprises a first structural unit formed of a first and a second ice impacting slope surface which surround a central core and a second structural unit including operational equipment which is supported by the first unit.

Another object of the present invention is to provide a marine operations structure having a plurality of moon pools located in a central core which is surrounded by a plurality of increasingly sloped ice walls which cause bending fracturing of encountered ice features.

Another object of the present invention is to provide a process of securing a marine operations structure at a given arctic sea site by providing for the contacting of multi-year ice features consisting of multi-year ridges embedded in multi-year floes by both a first and a second sloped surface whereby fracture propagation within the ice feature extends simultaneously from both such sloped surfaces.

Yet another object of the present invention is to provide a process of maintaining a marine operations structure at a fixed arctic site by providing for distribution of impact forces from ice features through a thick walled steel/concrete composite ice wall.

Yet another object is to reduce the heat transfer through the ice wall by the design of the steel/concrete composite ice wall.

Yet another object is to provide a process of fabricating a marine operations structure by fabricating first and second ice walls of a sloping support base system by use of a slip-forming operation.

Another object of the present invention is to provide a process for installing a marine operations structure at a given site by the use of sequential ballasting of internal tanks to maintain trim of the structure during deployment and to thereafter increase foundation pressure for the structure by continued ballasting of tanks located above and below sea level.

Overview of Problems Solved

There are several significant set of problems in the construction, mobile deployment, and maintenance of site location for arctic operations structures.

The marine operations structure of the present invention can be constructed at significantly lower costs than prior structures due to the use of modular, repetitive sections which are utilized to form the polygonal supporting base of the structure. The avoidance of arcuate and curved reinforcing members in the underlying superstructure also reduces fabrication costs about 45% compared to structural and shipyard costs for conical sections. The slip-forming method of constructing the ice walls on the first and second sloped surfaces with normal density concrete is both low cost in construction and results in the formation of a steel/concrete composite which can successfully resist both the large vertical and horizontal forces imparted by various ice features without permanent deformation or physical break-up.

The 16-sided polygonal support base encounters nearly the same horizontal and vertical forces as does a conical structure of the same size and configuration. That is, the ice features impinge on such a polygonal structure in nearly the same way. Thus the distribution of impact forces and the significantly lower construction costs combine with the result that the structure of the present invention is optimized for its technological and economic functions.

The installation of the marine operations structure is facilitated by the provision of cable attachments at positions extending more than 180 degrees around the structure. Installation is also significantly improved by the utilization of at least two series of radially arranged ballast tanks which can be sequentially flooded in order to found the structure on the sea bottom without significant listing or tilting. Raising and relocation of the operations structure is similarly facilitated by employment of the sequentially arranged tanks during the deballasting operation.

The most serious set of problems with respect to the maintenance of site location is due to the impact of multi-year ice pressure ridges embedded in multi-year ice floes. Ice islands, which could apply even greater force to arctic marine structures, are determined to occur sufficiently infrequently so that it is not necessary for the structure to be designed to resist these ice features. The surface ice floes extending in both the fore and aft directions from multi-year ice ridges are encountered and broken up by various feature modes which occur in such anisotropic ice features. During the break-up of the surface ice floe against the structure of the present invention, fracture planes radiate outwardly from the operations structure through the surface ice floe and into the advancing multi-year ice ridge. The multi-year ice ridge then impacts the structure on the lower positioned first sloped surface and is elevated above its flotation plane by its movement up the inclined plane. The fracture planes extend radially outward away from the structure and create weakened planes within the ice ridge. The out-of-plane bending fractures in the advancing ice ridge then simultaneously occur along these weakened planes in order to form a central hinge. Additional hinges are formed at outlying and spaced distances from the central hinge. The cooperating simultaneous fracturing of the multi-year ice ridge by radial fracture and by out-of-plane bending is enabled by the above described 0.15 to 0.30 proportioning ratio range for the annular dimension of the first sloped surface with respect to the structure radius. In this manner the marine opertions structure of the present invention fractures the multi-year ice pressure ridges by out-of-plane bending with lower vertical force, and thus, lower horizontal force imposed upon the structure than has been the case in the prior structures with sloping ice walls. The lower vertical force imposition then results in the structure maintaining its level orientation, and the lowered horizontal force results in the structure maintaining its position over the well site to permit continued drilling operations.

The steel/concrete composite ice walls of the marine operations structure are not permanently deformed or deflected by imposition of the high horizontal and vertical ice loadings from the multi-layer ice ridges which thus enables the structure to be maintained at given site locations for prolonged periods.

Another problem which is solved by the structure of the present invention is that the operational equipment unit which includes the multi-deck operations assembly is capable of storing sufficient supplies for drilling up to five wells of 15,000 feet each. The drilling capacity materially reduces logistics costs which are associated with prior arctic structures.

BRIEF DESCRIPTION OF THE DRAWINGS

FIG. 10 is an enlarged detailed view of the lower right quarter of the structure shown in FIG. 8;

FIG. 10A is a detailed structure cross-sectional view of the bottom skirt members taken on line 10A—10A of FIG. 10;

FIG. 10B is a schematic layout view showing the bottom skirt layout pattern under a quarter section of the central core;

FIG. 11 is a detailed cut-away view of a one quarter portion of the central core construction framing;

FIG. 29 is a schematic cross-sectional diagram of the marine operations structure of the present invention showing the relative positions of various ballast tanks and oil tanks within the structure;

FIG. 30 is a schematic top view of the operations structure under tow to an operational site;

FIG. 31 is a schematic diagram of the installation process for the operation structure at a given sea location; and FIG. 32 is a fragmentary side elevation view showing a surface flotation materials dock connected to the side of the marine structure of the present invention.

DESCRIPTION OF THE PREFERRED EMBODIMENT

Figure 1:
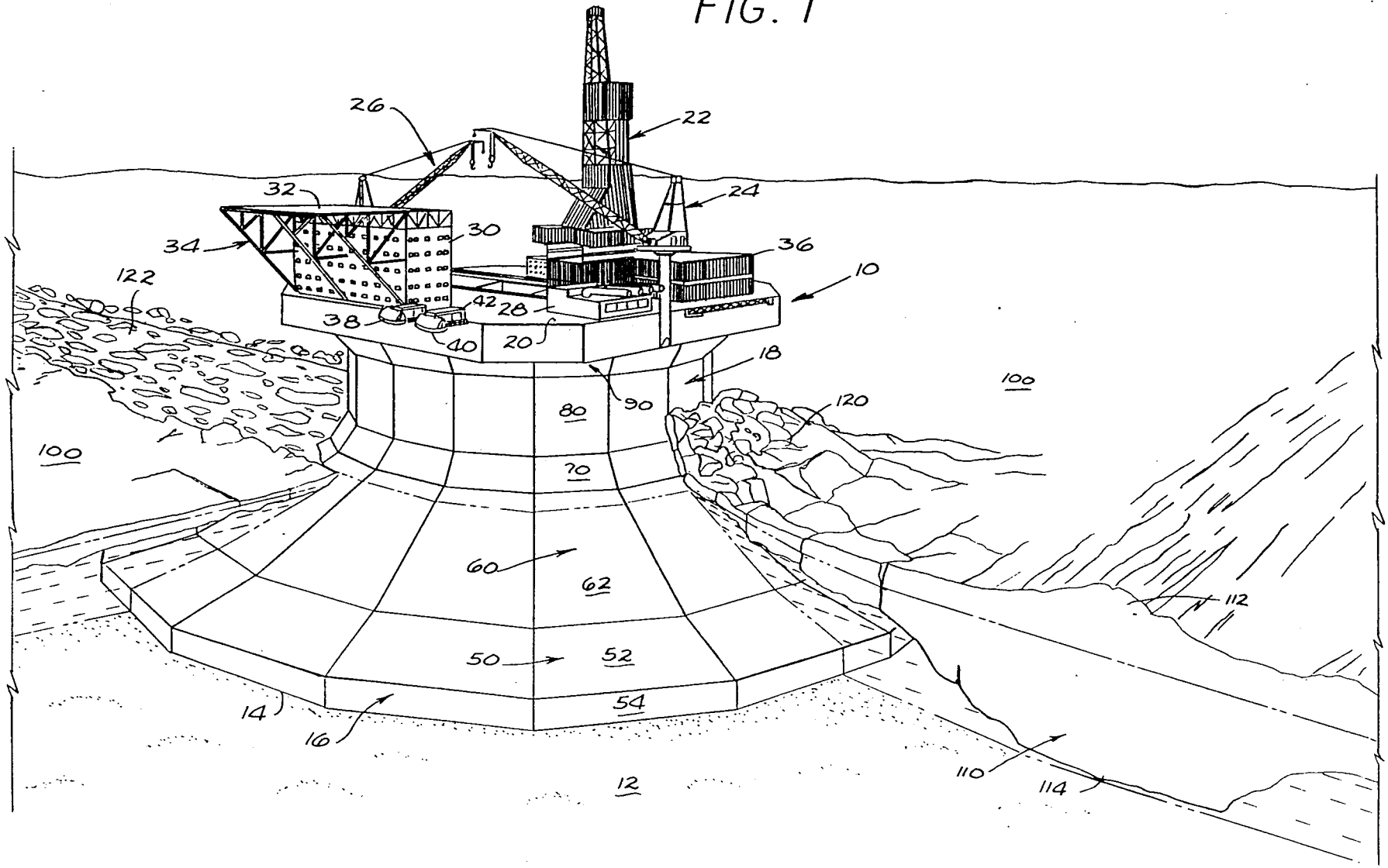
FIG. 1 is a perspective view of the marine operations structure of the present invention when located in an ice floe showing an impacting multi-year ridge.

FIG. 1 shows the operations structure 10 installed on a sea floor 12 in an arctic sea at a water depth of about 55 feet. The sea floor is composed mainly of pleistocene clays and holocene silts which have low force bearing properties, and hence the base 14 of the structure 10 is constructed to have a large planar area for contacting the sea floor 12. The diameter of the structure is between about 120 to 180 meters.

The structure 10 is composed of a polygonal sided support base 16, a central column 18 and a main deck 20 which has a movable drill rig 22 mounted on the top surface thereof. The support base 16 extends from the sea floor up above the waterline. Pedestal cranes 24 and 26 are provided for equipment movement and loading-/unloading of materials. A power plane 28 and living quarters 30 are provided. A helicopter pad 32 is provided on top of living quarters 30 by means of a truss structure 34. Additional casing storage compartments 36 are also provided on main deck 20. Escape capsules 38 and 40 are also provided on cantilevered mounting, such as 42.

The drilling package including rig 22 and casing storage compartments 36, power plane 28, living quarters 30, and the helipad 32 can all be constructed as modules and placed onto structure 10 in the final construction and outfitting phases.

The support base 16 is formed by the fabrication of sixteen modular sections which are united around a central core, the outside of which core can be seen as central column 18. Each of the sixteen segments has an outer flange 50, the upper surface of which consists of an ice wall 52 which is constructed as a steel/concrete composite having unique force-bearing properties as hereinafter described. A vertical outer wall toe portion 54 connects base 14 with the first sloped ice wall surface 52.

Each of the segments of support base 16 is also constructed with an upper ice wall section 60 which is integrally formed with the first sloped ice wall 52. The second sloped ice wall 62 is a continuation of ice wall 52 and is positioned to encounter and break up surface ice floes.

Connector skirt portions 70 are connected from the top of each of the support sections 60 to the bottom ends of the outer panels 80 which form the outer surface of the central column 18. At the upper end of each of the panels 80, an outwardly flared support section 90 is positioned to provide additional support for the undersurface of the main deck 20, which is constructed with several internal deck levels.

The described structure is intalled in a given position on the sea floor 12 in an area which is covered for about nine months of the year with sea ice. Shown in FIG. 1 is a multi-year floe 100 which is from about 5 to 30 feet in thickness. Also shown in FIG. 1 is a multi-year ice pressure ridge 110 which has a sail portion 112 and a broad base keel 114. The ice impact properties of structure 10 and, in particular, the ice walls 52 and 62, must be sufficient to withstand the forces generated by the break-up and fracturing of the multi-year ice ridge 110. Also, the placement of the structure 10 on the sea floor 12 and the stability of the structure 10 must be sufficient to prevent slide-off and displacement of the structure from its given position.

The movement of the ice floe 100 against the structure 10 causes an ice rubble buildup 120 at the upstream position of the ice movement and a cleared pathway 122 with broken ice slabs on the opposite side of structure 10.

Arctic Ice Features and Fracture Mechanics

Figure 2:
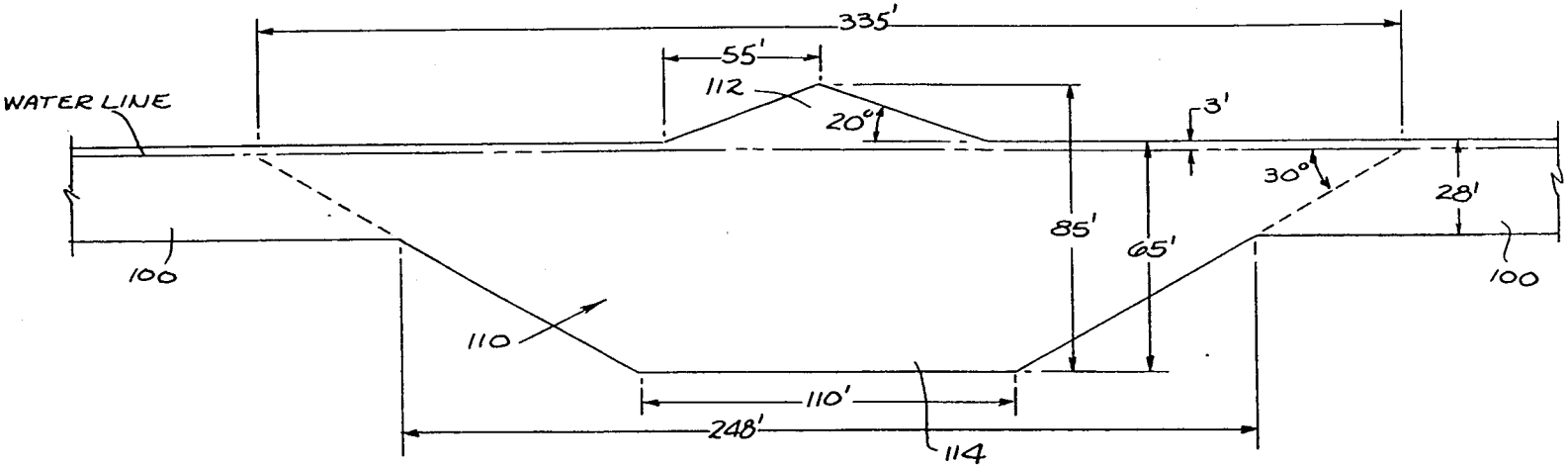
FIG. 2 is a schematic vertical elevation cross-sectional view of a multi-year ice ridge embedded in a multi-year floe.
Figure 3:
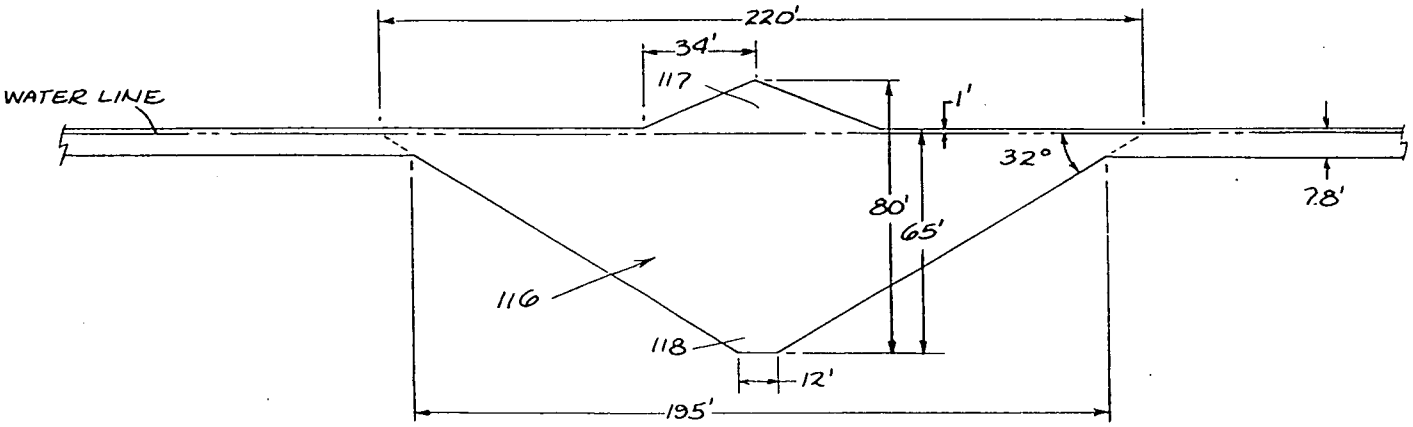
FIG. 3 is a schematic vertical elevation cross-section view of a first-year ice ridge in first-year sheet ice.

The magnitude of the potential for displacement of structure 10 and interruption of operations can be best understood from a description of FIGS. 2 and 3 which show cross-sectional diagrams for a multi-year ice ridge embedded in a multi-year floe and for a first-year ice ridge in first-year sheet ice. The dimensions shown for these two types of ice features found in arctic seas are the result of multiple studies which have tended to confirm the dimensions shown as being representative of such features. As seen in FIG. 2, the pressure ridge 110 has a width measured from its lower contact point with the surface ice floe of about 248 feet. The keel 114 is generally comprised of consolidated ice and is about 110 feet in width. The sail portion 112 has a total width of about 110 feet which is centered above the broad-based keel 114. The sail height is about 20 feet. The angle of incline of the bottom of the multi-year pressure ice ridge with respect to the bottom of the planar surface ice floe is about 30°. The angular relationship is related to the ice-fracturing mechanics as hereinafter described.

The multi-year ice floe and the multi-year floe ridge float with about a 3-foot clearance above the water-line. These multi-year ice ridges have lengths of up to about 5,000 feet, and the total width of the ridge is about 335 feet, measured at the top surface as shown. Such ice features impose large horizontal forces when fixed structures are encountered. The force range is from about 30,000 kips to about 200,000 kips (1 kip equals 1,000 pounds). Thus, impact forces of between 30 million to 200 million pounds are to be expected from such ice features.

The first-year pressure ice ridges 116 are of similar depth and have sail portions 117 of similar heights. The keels 118, however, are an order of magnitude narrower than in multi-year pressure ridges, and are only partially consolidated. The first-year sheet ice in which the ice ridge is embedded grows to about 7.8 feet thick, as compared with 28 feet in the multi-year case. Hence, proportions and positioning of the elements of the structure 10 and the construction of the ice impact wall must be such that both first-year and multi-year ice ridges can be successfully handled.

Figure 4B:
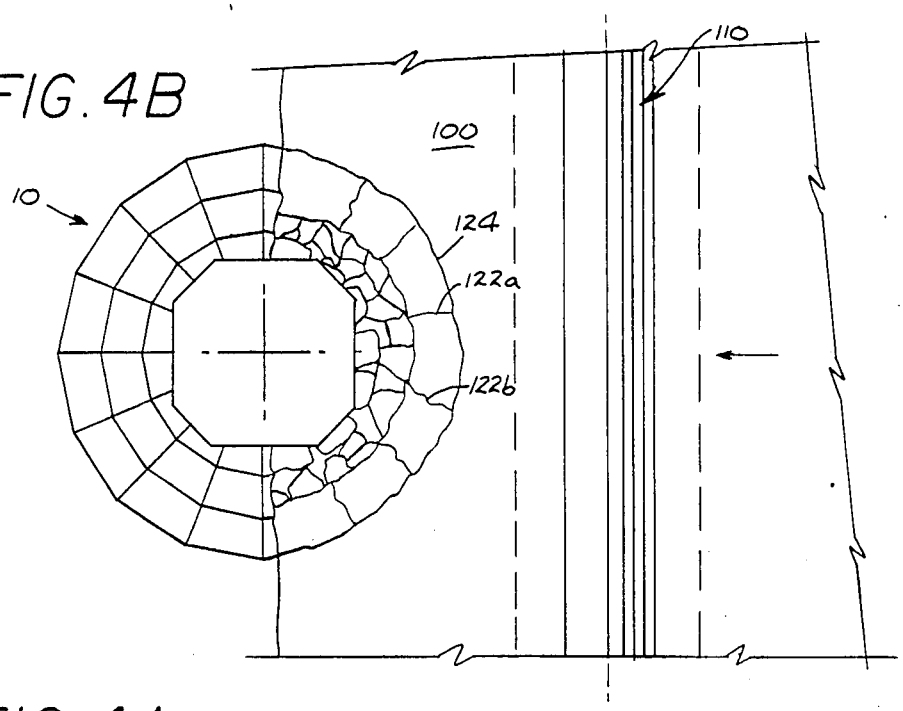
FIG. 4B is a top view of the marine structure shown in FIG. 4A.
Figure 4A:
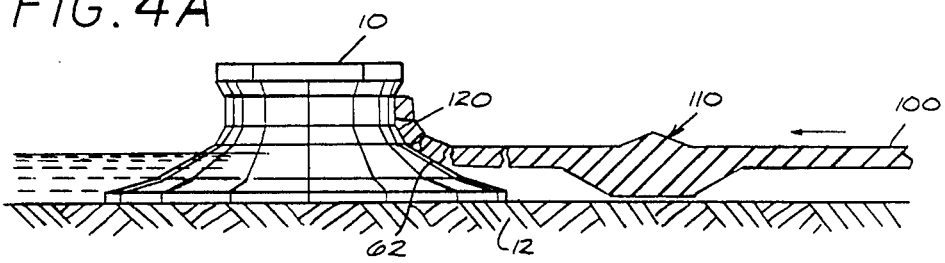
FIG. 4A is a side elevation schematic view of the marine structure of the present invention shown with an impacting ice floe containing a multi-year ice ridge.
Figure 6:
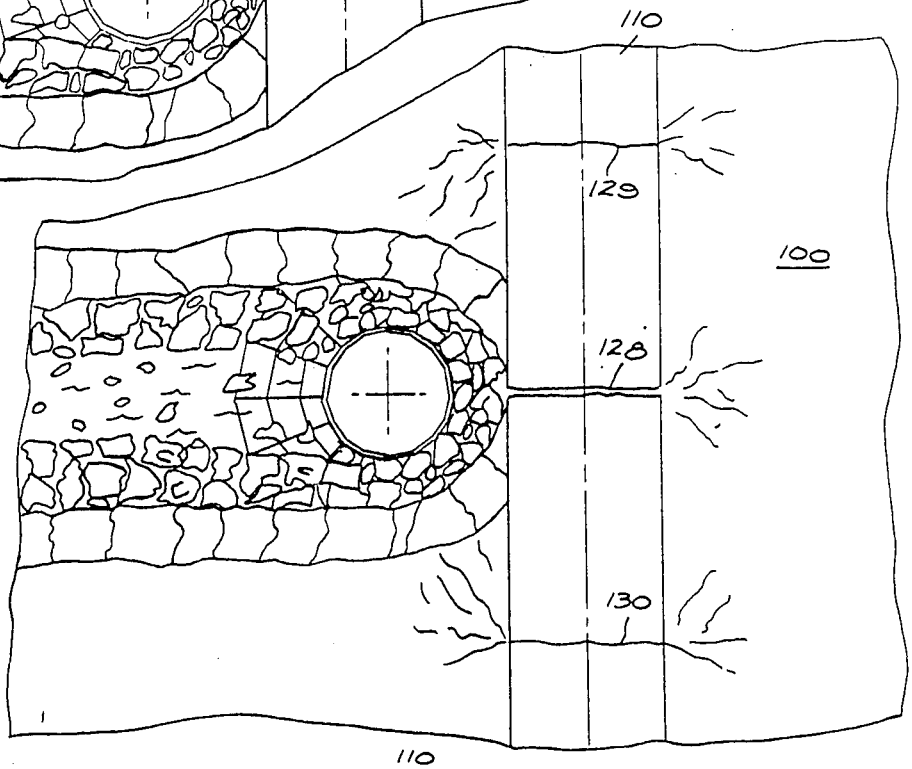
FIG. 6 shows a schematic view of the subsequent formation of outlying hinge cracks in the multi-year ice ridge shown in FIG. 5B.
Figure 7:
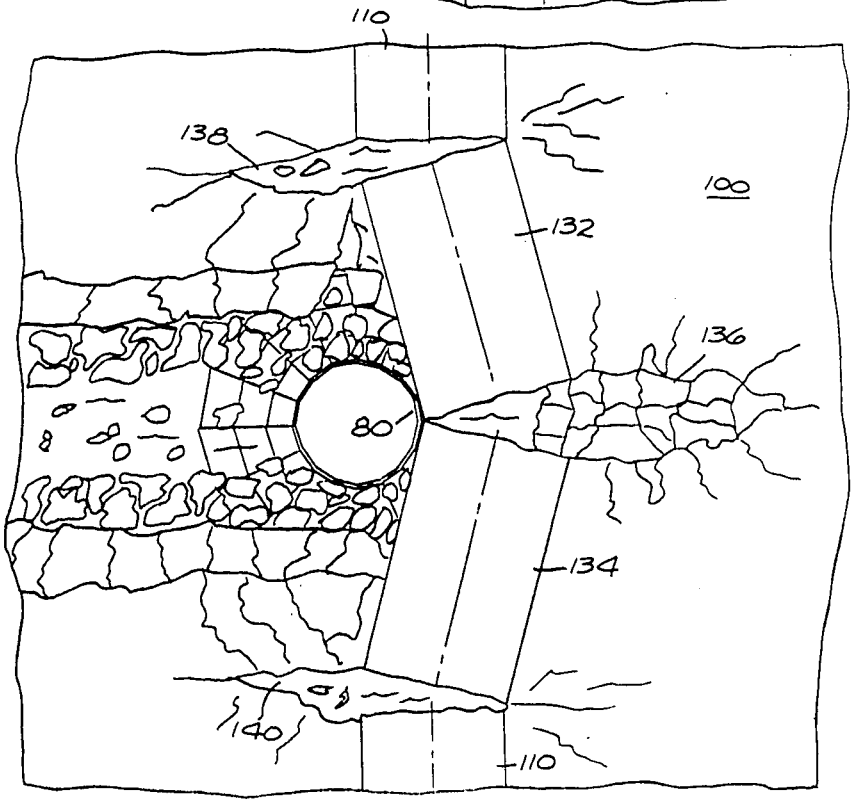
FIG. 7 shows schematically the breakup and bypass of the multi-year ice ridge portions on either side of the mobile structure of the present invention.

FIGS. 4A and 4B show the break-up of the multi-year ice floe 100 against the second sloped surface 62 of structure 10. The ride-up of ice rubble 120 is a main feature of this ice fracturing and accounts for about 30 percent to 40 percent of the total ice loading forces imposed on the structure. FIG. 4B shows that the multi-year ice floe 100 is fractured along radial break or fracture lines 122*a* and 122*b* as well as circumferential fracture lines 124. The ice plates thus formed are, of course, further broken up as rubble by grinding and comminution action. The central column 18 of the structure 10 is of substantially smaller diameter than that of the support base 16. Also the upper edge of the outwardly flared support section 90 is of greater diameter than that of the central column 18. This configuration causes the ice rubble 120 to ride-up the central column as shown in FIG. 4A, with some of the rubble falling back onto the fractured floe below and with some of the rubble flowing around the central column, as shown in FIGS. 6 and 7.

Figure 5A:
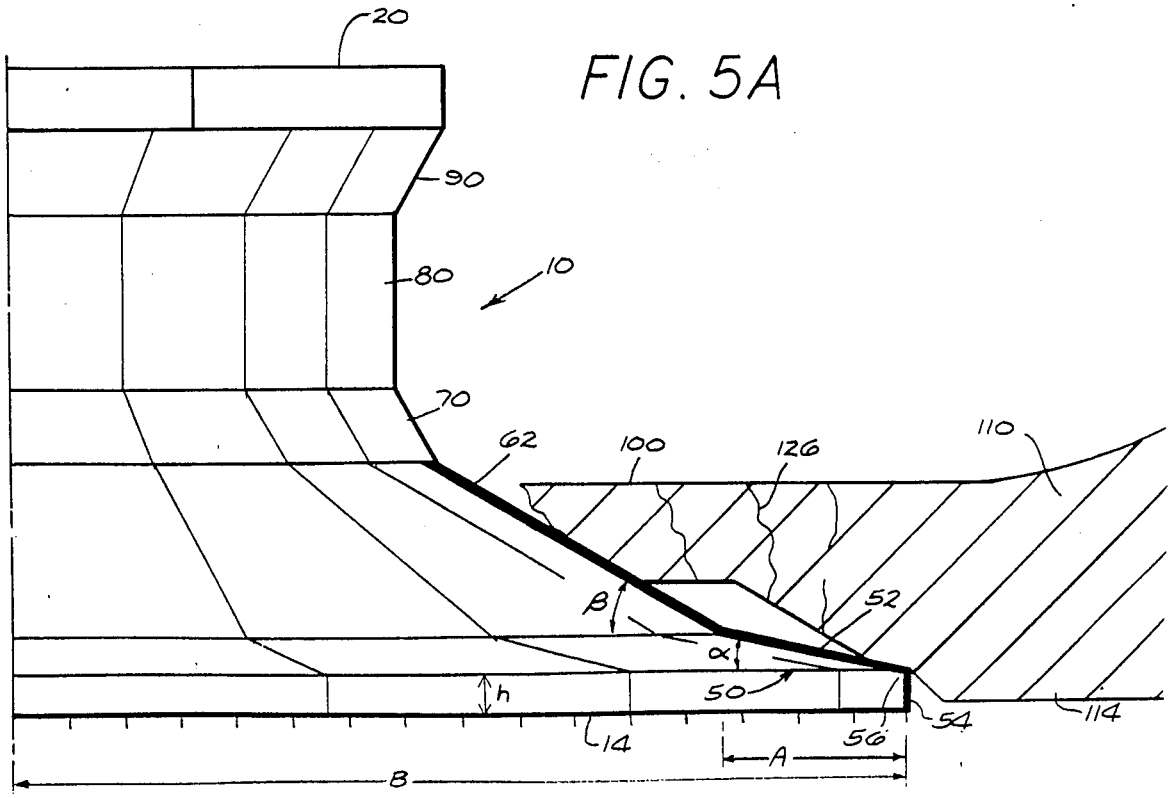
FIG. 5A shows a schematic view of the simultaneous contact with both the first and second sloped surfaces of the structure of the present invention by an ice feature containing a multi-year ice ridge.

The initial impact of the multi-year pressure ridge 110 with the structure 10 is shown in FIG. 5A. The preceding multi-year planar ice floe 100 has been previously broken up and fractured against the ice wall 62 of the second sloped surface section 60. This ice floe fracturing is a continuous ongoing process as the angular bottom portion of the keel 114 of the multi-year pressure ice ridge is forced over the top region 56 of outer flange toe portion 54. The underside of the ice ridge 110 tends to be soft and mushy and not to have a high compression strength. During this impact phase, the ice fracturing is still predominantly effected by the second sloped surface 62, and the radial fracture lines 122*a* and 122*b* from this upper impact surface extend radially away from structure 10 into the advancing ice ridge 110, as shown by fracture propagation fronts 126. The effect of these fracture fronts is to create weakened stress planes which advance into the moving ice ridge 110. As the ice ridge continues its collision course with the fixed structure 10, the ice ridge is lifted onto the outer flange 440 by the inclined plane wedging action and is then fractured by out-of-plane bending along the lines of the radial fracture planes. In this manner, the second sloped surface 62 cooperates with the first sloped surface 52 in order to fracture the advancing ice ridge at lower vertical force than would otherwise be encountered by the outer flange 30. The radial fracture planes along the advancing fracture fronts lower the flexural strength of the ice ridge and thus permit out-of-plane bending fracturing with lower vertical forces.

The proportioning and positioning of the outer flange 50 is such that the horizontal length, A, of the flange is small compared to the radius, B, of the structure 10, as shown in FIG. 5A, so that the second sloped ice wall 62 is encountered by the ice features in a close-spaced configuration with respect to the surface ice floe 100 and the advancing ice ridge 110. The range of the ratio A/B can vary between 0.15 and 0.30, and angle alpha for surface 50 can be 8° to 25° and angle beta for surface 62 can be 25° to 45°. If the outer flange 50 was made very wide, the fracture planes extending radially would not extend into the ice ridge and would not weaken the ice ridge prior to its lift-up on the outer flange 50.

Figure 5B:
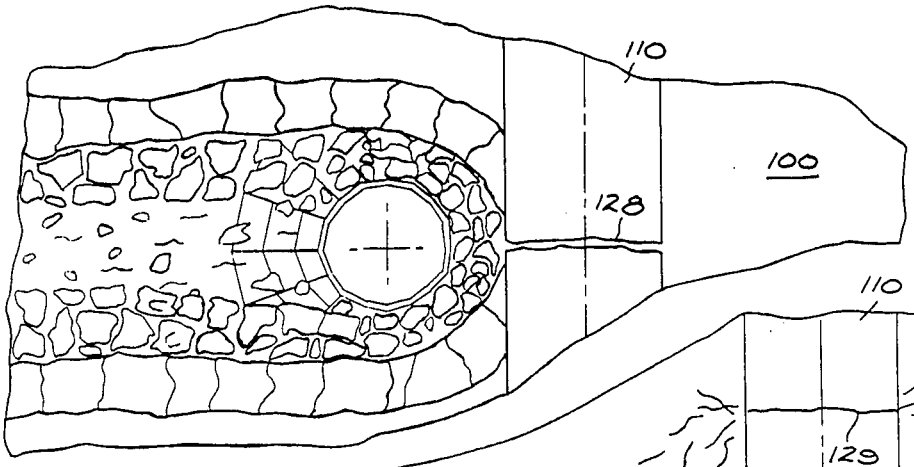
FIG. 5B shows a schematic view of the initial central crack formed by out-of-plane bending failure of a multi-year ice ridge.

The initial out-of-plane bending fracture line 128, which is effected when the ice ridge 110 has fully encountered both the first sloped surface, is shown in FIG. 5B. This fracture 128 is referred to as the central hinge. Continued advance of the ice ridge 110 against the two sloped surfaces raises the ice ridge out of its flotation plane and then causes hinge fractures 129 and 130 to form at outlying planes, as shown in FIG. 6. This multi-year ice ridge 100 is thus broken along three planes by out-of-plane bending as shown in FIG. 7 and the segments 132 and 134 then impact the skirt portion 70 and, to some extent, the central column 80 as they break and flow on either side of the structure 10. The break-up of the two ridge portions 132 and 134 also causes central area surface floe fracturing 136 in the advancing multi-year ice floe 100 and additional fracturing and break-up along the hinge fractures as shown by break-up portions 138–140.

Construction Elements of Structure 10

Figure 8:
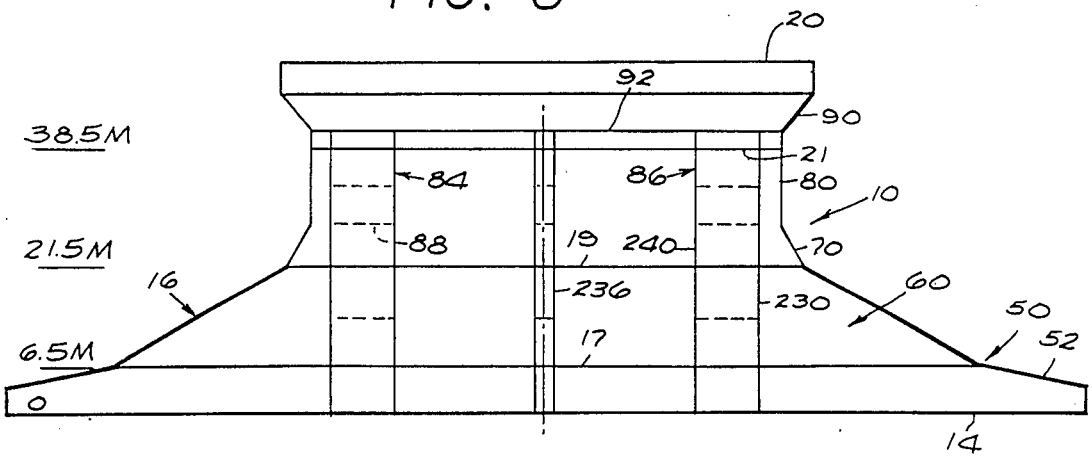
FIG. 8 shows a schematic vertical elevation cross-sectional view of the marine structure of the present invention.
Figure 9:
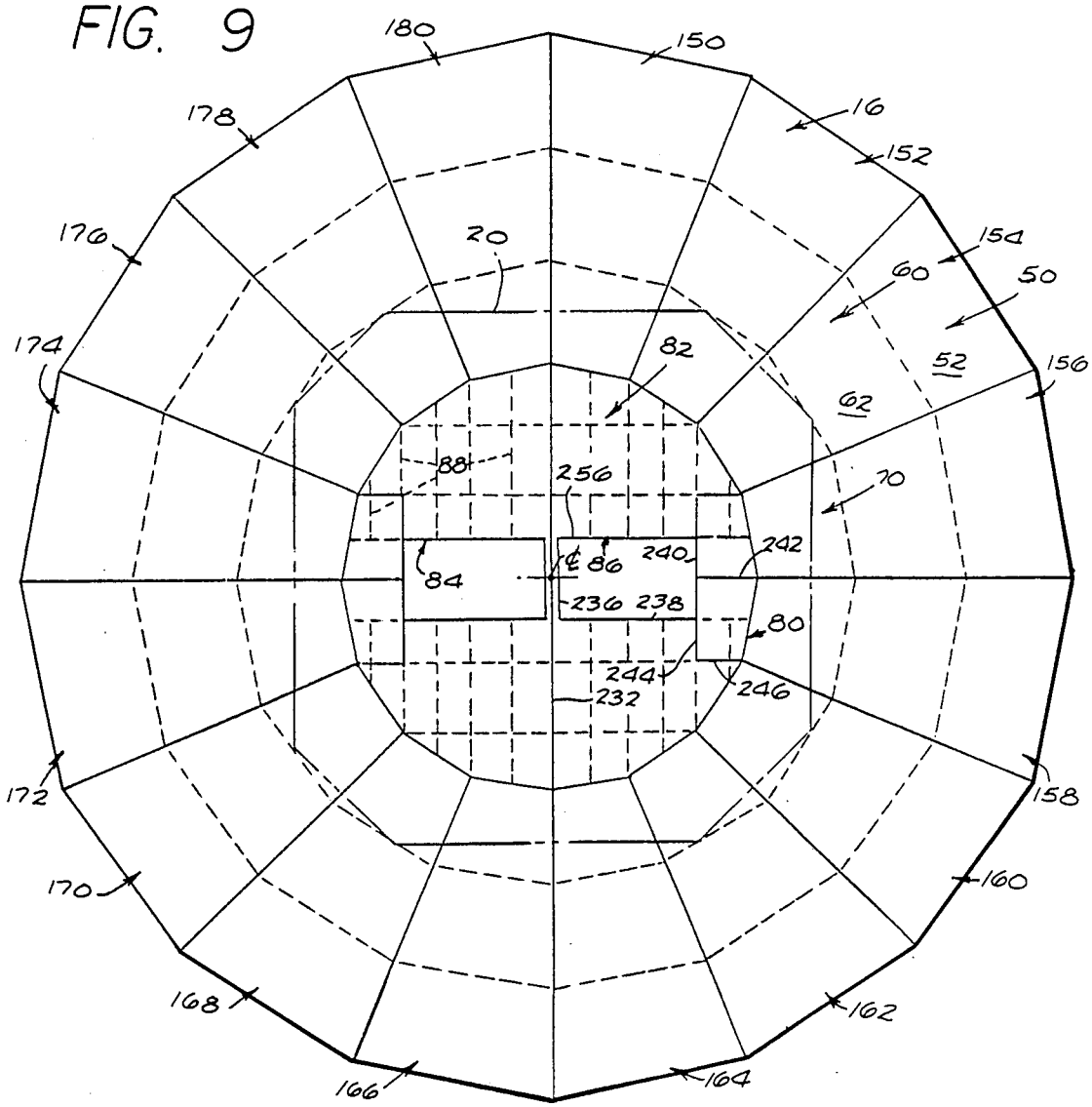
FIG. 9 shows a top schematic view of the structure shown in FIG. 8.

The general arrangement of structure 10 is shown in FIGS. 8 and 9 as having a central bore 82 containing two rectangularly shaped moon pools 84 and 86 which extend through the main deck 20 and the base 14 to provide access to the sea floor 12 as shown in FIG. 4A. The central core 82 has the central column 80 disposed circumferentially thereabout. The lower end of the central column 80 is connected to the sloped skirt portions 70 of each of the segments and support base 16. The skirt portions 70 are, in turn, connected to the upper edge of the second sloped surface sections 60. The outer flange 50 is then connected below the second sloped surface in order to form the first sloped surface 52.

Within the structure 10, liquid-tight flats are positioned to construct different levels of liquid containing tanks. At an elevation of about 6.5 meters watertight flat 17 is positioned at the upper edge of the outer flange 50. At 21.5 meters another watertight flat 19 is extended from the upper edges of the second sloped surfaces 60 throughout the central core 82 for the same purpose. An oil tight flat 21 is extended throughout the structure to permit oil storage in four shallow tanks below the cellar deck 92.

Also shown in FIGS. 8 and 9 are the vertical liquid tight bulkheads which are utilized for forming the moon pools 84 and 86 and for providing access passages lower levels within structure 10. These vertical bulkheads will be described in greater detail with respect to FIGS. 10, 11 and 12 but have been numbered in FIGS. 8 and 9 for reference during that later description.

As shown in FIG. 9 the outer walls of the central column 80 consist of sixteen wall panels which are arranged symmetrically about the vertical centerline of the structure 10. The support base 16 is also constructed of sixteen identical frustum shaped sections which make up the sloped outer surfaces 52, 62 and the skirt sections 70.

Internal reinforcing members 88 are provided within the central core 82 as hereinafter detailed. FIG. 9 shows the main deck 20 overhanging the central column 80.

Detailed Construction and Reinforcement of Support Base 16

FIGS. 10–20 and 22–24 shows various aspects of the construction of support base 16, central core 82, outer central column 80, and main deck 20. As shown in FIG. 9 frustum sections 150–180 are arranged circumferentially around the central core 82. These modularized support base segments can be mass produced at acceptable cost levels because they are repetitive units having the same internal reinforcement structure and are constructed of flat plates and bulkheads which do not require arcuate components as in the case of circular/-conical foundation structures.

As shown in FIG. 10 base plate sections 186, 188, 190 and 192 are fabricated for each of the base support segments 158, 160, 162 and 164, respectively. A bottom skirt pattern 194 is first laid out under each of these bases in order to provide foundation stability. The skirt layout consists of an extension skirt 196 on the bottom side of the base plate sections as shown in FIG. 10A. The skirts 196 are positioned immediately below a bulkhead, frame or girder member 198. Reinforcing stiffeners 200 and 202 are provided at intervals determined by the placement of cross positioned reinforcement member within the base of structure 120. These skirts 196 are interconnected at corners illustrated by corner 204 in segment 164. It is preferable to utilize 25 millimeter plate for the base plate section member 192.

On the top surfaces of the base plate sections 186, 188, 190 and 192, a series of bulkheads 206A and 206B are joined at intervals of about 3 meters. These bulkheads extend radially away from the central core 82 along the top surface of the base plate sections 186–192 and are non-liquid-tight or swash bulkheads. A series of girders 208 are then arranged perpendicularly with respect to the bulkheads 206A, 206B and are thus positioned in approximately circumferential or chordal positions with respect to the central core 82. These girders are then further reinforced by stiffener sets 210 which are placed parallel to and between adjacent bulkheads. The interrelationship of these construction components are further described with respect to FIGS. 16 and 19.

Each of the base support segments 158, 160, 162 and 164 is constructed with shared liquid-tight bulkheads shown as bulkheads 212, 214, and 216 for segments 158 and 160. A single shared fluid-tight bulkhead such as 214 is provided between adjacent segments.

Also fastened to the top surface of base plate sections 186 and 188 are non-tight circumferentially arranged web frames illustrated by bold lines as 218 and 220 for segment 158, and 222 and 224 for segment 160. These non-tight or swash bulkheads and web frames are formed with openings with permit the through flow of sea water for ballasting purposes. The bulkheads 206 which are positioned radially have openings which permit the communication of fluids within each of the frustum segments 150–184 of the support base 16. The height of each of the swash bulkheads 218, 222, 220, 224 and the sloped upper surfaces of the watertight bulkheads 212, 214 and 216 are constructed to provide the foundation reinforcement of the first and second sloped surfaces 50 and 60 of each of the frustum sections illustrated as 158, 160, 162, and 164 in FIG. 10.

Construction Of Central Core

Turning now to central core 82, a twenty-five millimeter base plate 226 is provided with two rectangular moon pool openings 84 and 86. On the bottom surface of the base plate 226 a depending skirt pattern is laid out corresponding to the pattern 194 in the base plate 186–192 of the support base 16. The pattern of the skirts 228 is rectilinear as shown for the central core quadrant in FIG. 10B. This pattern consists of five skirts laid out in the x-direction and eight skirts laid out in the y-direction. The outside edges of these skirts along the core perimeter wall 230 engagement are joined with selected skirts fastened to the underside of the base plate sections 186–192 as shown in FIG. 10.

The central core base plate 226 is then used as the base support for a series of fluid-tight and swash bulkheads. The fluid-tight bulkheads are those shown in core 82 in bold lines in FIG. 10 and consist of bulkheads 232, 234, 236, 238, 240, 242, 244 and 246. These watertight bulkheads extend vertically throughout the height of the central core. The core perimeter wall 230 is formed from the series of liquid-tight bulkheads 248–254. The rectangular moon pool 86 is thus bound by fluid-tight bulkheads 236, 238, 240 and 256. Within the quarter section of the central core 82 shown in FIG. 10 a rectilinear pattern of non-tight bulkheads 258 and 260 in the x-axis direction and 262, 264, 266, 268 and 270 in the y-axis direction are also positioned. Between the non-tight and liquid-tight bulkheads a series of base girders 272 are laid out in an x-axis direction and are equally spaced from one another in the y-axis direction. Perpendicularly arranged stiffener reinforcements shown as dashed lines 274 are laid out in a y-axis direction and spaced from one another in an x-axis direction. This rectilinear pattern of reinforcing members 272 and 274 is welded to and effectively strengthens the core base plate 226 and provides rigidity of the base plate between the liquid-tight and non-tight or swash bulkheads which are also affixed to the base plate 226.

The depending stability skirt pattern shown in FIG. 10B coincides in the x-direction with the fluid-tight and non-tight bulkheads 232, 262, 264, 266, 244 and also 268. The depending skirt pattern coincides with both the fluid-tight and non-tight bulkheads laid out in the same x-axis direction as well as selected base girders or members 272. Thus, the construction of the reinforcing elements serves to mutually reinforce the depending skirt pattern by the reinforcements affixed to the top surface of base plate 226. The base plate, skirts, bulkheads, girders, stiffeners and other reinforcement elements are constructed of steel and the connections therebetween are welded.

The construction of the other three base quarter sections are the same as for FIGS. 10, 10A and 10B with necessary modification for difference in positioning between the four quarter sectors.

Figure 12:
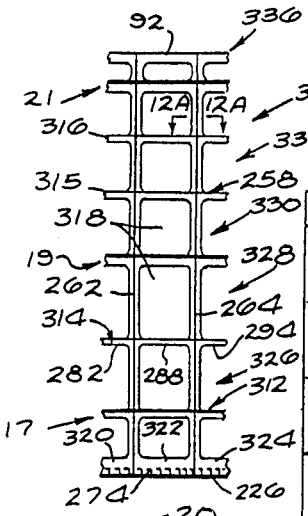
FIG. 12 is a fragmentary side elevation view of the central core structure members shown in FIG. 11.
Figure 12A:
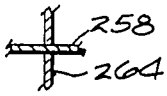
FIG. 12A is a horizontal cross-sectional view of the central core structural members taken on line 12A—12A of FIG. 12.

In order to strengthen each of the quarter sections of the central core 82 at spaced vertical positions, a series of standardized horizontal flat structural frames are interposed between the vertical fluid-tight and non-tight bulkheads. FIG. 11 shows a row of framing elements 280, 282, and 284 arranged in the x-axis direction between fluid-tight bulkhead 232 and non-tight bulkhead 262. The next row of frame elements consists of frames 286, 288 and 290 arranged parallel to the first row. The next row of frames 292, 294, and 296 are also positioned in parallel between the non-tight bulkheads 264 and 266. The fourth row of frames 298, 300 and 302 are positioned between the non-tight bulkheads 266 and the combination of the fluid-tight bulkhead 244 and non-tight bulkhead 268. The quarter panel framing is completed with frames 304, 306, 308 and 310 as shown. The thus constructed frames are joined to each of the watertight and non-tight bulkheads in order to form a quarter panel flat framing deck 314 which is positioned above the fluid-tight flat 17 as shown in FIG. 12. This same framing pattern is utilized at the higher elevation positions as shown by numerals 315 and 316. Side views of the individual frames 282, 288 and 294 are shown in the sectional elevation view illustrated in FIG. 12. The openings 318 shown in FIG. 12 are openings in the non-tight bulkhead 258. The joining of the non-tight bulkhead 258 with non-tight bulkhead 265 forms a cruciform intersection shown in FIG. 12A.

During construction, the non-tight bulkhead 258 is built up by joining bulkhead sections 320, 322 and 324 on either side of the non-tight bulkheads 262 and 264. These non-tight bulkheads are constructed in a similar manner with respect to bulkhead 258 so that the internal framing construction within core 82 is a series of cubic framed spaces as illustrated in FIGS. 11 and 12. The successive frame layers 326, 328, 330, 332, 334 and 336 are similarly built up during construction. The flat frames illustrated in FIG. 11 and positioned vertically as frame decks 314, 315 and 316 can also be used in association with the watertight flats shown by bold lines as 17, 19 and 21.

Also shown in FIG. 12 is the series of reinforcing stiffeners 274 affixed to core base plate 226.

Construction Of Central Core Vertical Wall 230

Figure 13:
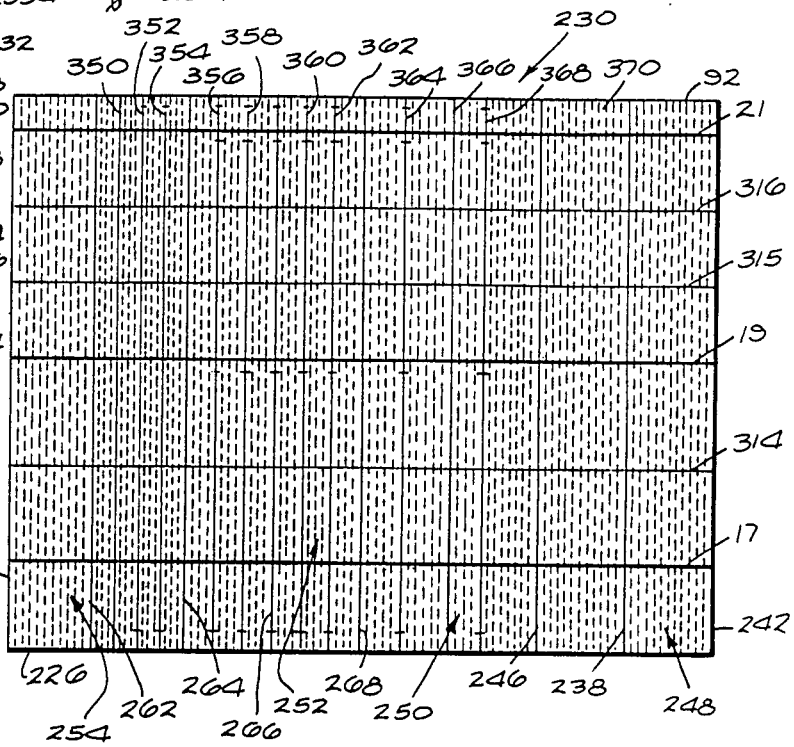
FIG. 13 is a planar layout view showing the reinforcing pattern utilized in the construction of the central core taken on line 13—13 in FIG. 10.

The schematic layout of the liquid-tight vertical bulkheads 232, 246, 238 and 242 as well as the watertight flats 17, 19 and 21 are shown in bold lines in the FIG. 13 planar layout of the central core peripheral wall 230. The non-tight vertical bulkheads 262, 264, 266 and 268 are shown also. A series of vertically disposed girders 350–368 are also positioned between the vertically arranged bulkheads to provide for additional strength. Between the vertical bulkheads and the girders parallel arranged stiffeners 370 are spaced from one another and attached to the inner surface of the peripheral core wall panels 248, 250, 252 and 254. These girders join near base plate 226 with the series of girders 274 which are affixed to the upper surface of base plate 226 (See FIG. 12). In this manner the central core 82 is constructed as a highly reinforced central structural member which is internally reinforced by the cubic frame construction described with respect to FIGS. 11 and 12. This central core 82 provides an integral unit about which the frustum base support sections shown as 158, 160, 162 and 166 in FIG. 10 can be connected. Each of the other three structure quadrants is similarly constructed.

Vertical Section Construction Of Support Base 16

Figure 14:
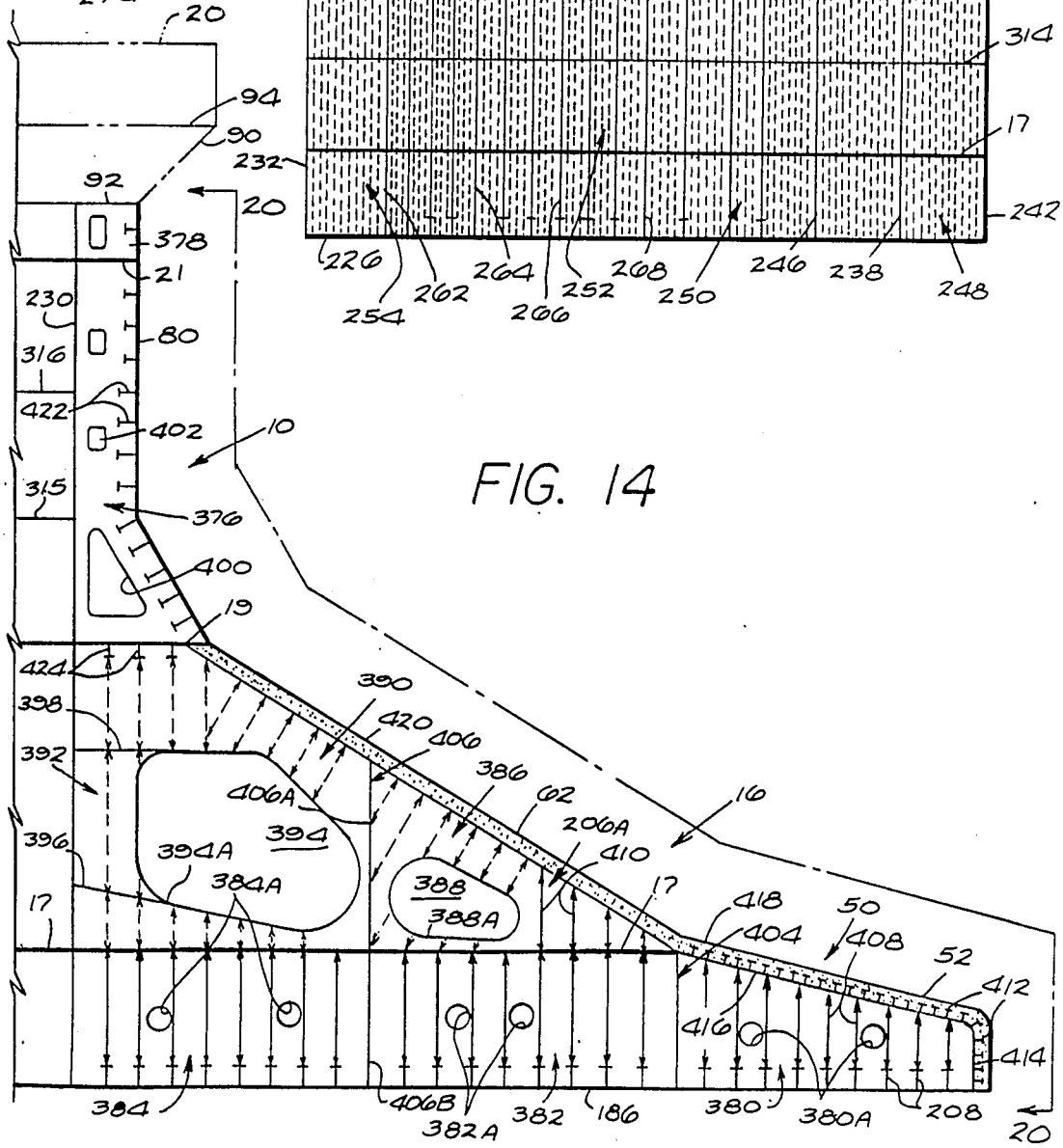
FIG. 14 is a schematic vertical elevation view of a radial reinforcing bulkhead showing the positioning of circumferential bulkhead reinforcements and the steel/-concrete composite ice wall.
Figures 15, 16:
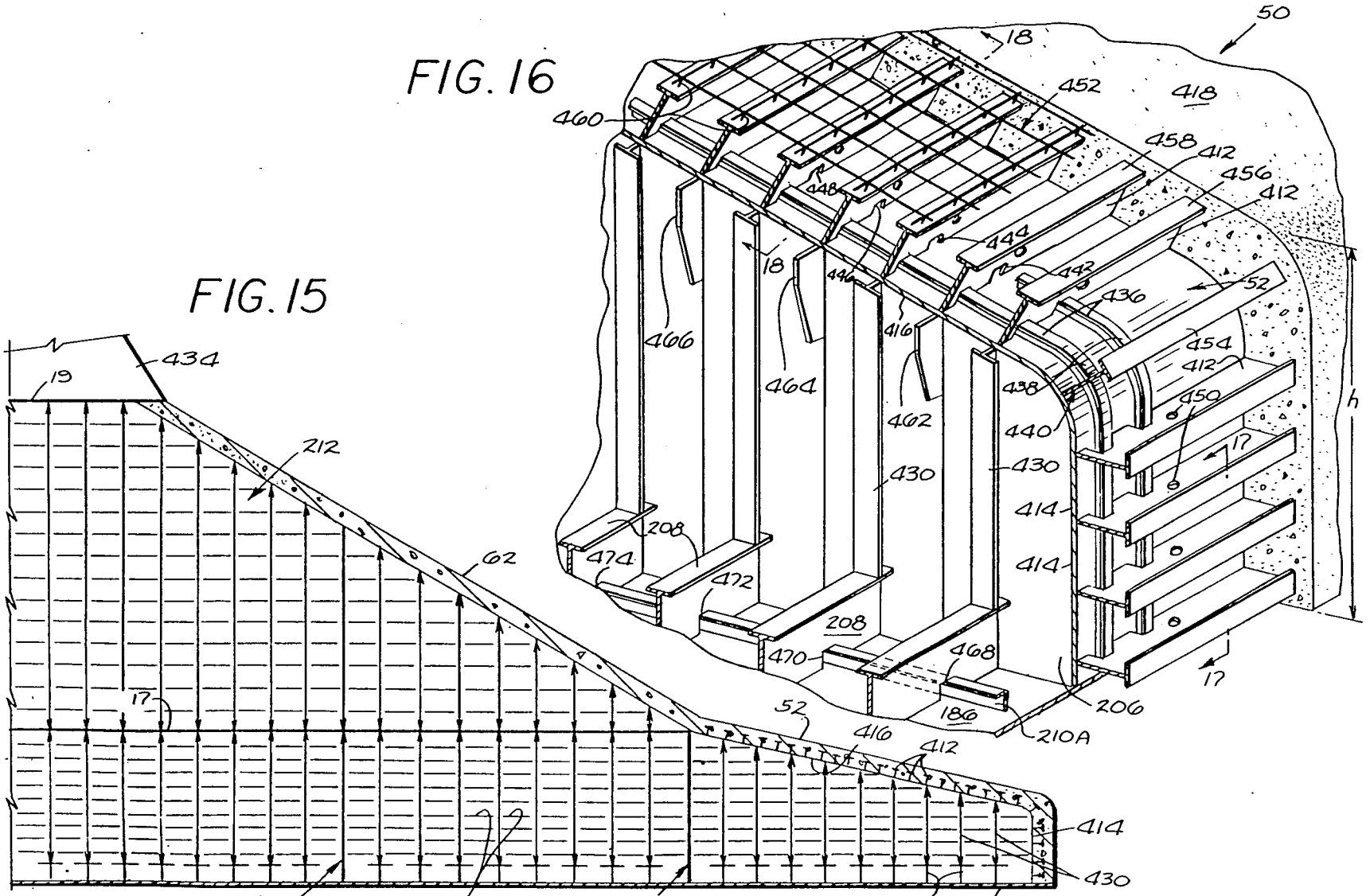
FIG. 15 is a is a schematic vertical elevation view of a radial fluid bulkhead showing the positioning of circumferential reinforcing members thereon.
FIG. 16 is a detailed cut-away perspective fragmentary view of the ice wall of the outer flange showing the internal reinforcement therefor.

The frustum sections 150–180 of FIG. 9 are constructed with watertight bulkheads having the shape shown in FIG. 15 as the outer walls and with non-tight bulkheads of a shape shown in FIG. 14. As shown in FIG. 10 for section 158, five full length non-tight bulkheads illustrated as 206A are positioned within each of these sections with four partial non-tight bulkheads 206B positioned in pairs at the sides of the full length bulkheads. This pattern of reinforcement bulkheads is repeated in each of the other sections 150–180. Referring now to FIG. 14, a non-tight or swash bulkhead 206A is shown positioned within base support 16 of structure 10. This bulkhead 206A is attached to the upper surface of base plate 186 and is intersected at a first elevation level by watertight flat 17. The upper edge of bulkhead 206A is attached to watertight flat 19. A vertical extension non-tight bulkhead 376 is positioned in the same vertical plane on the top surface of watertight flat 19 and extends up to the oil tight flat 21. A spacer bulkhead 378 is then positioned in the same vertical plane and connected to the cellar deck 92 which is also an oil tight flat. The main deck 20 and tweendeck 94 are then connected above the cellar deck. The arrowheads on panels, girders and the like indicate the end of a member abutting another member.

The non-tight bulkhead 206A can conveniently be fabricated by modular bulkheads 380 for the outer flange; module 382 for the lower and next innermost section and module 384 for the lower level section connected to the core perimeter wall 230. Holes 380A, 382A and 384A are cut in the lower level modules 380, 382 and 384 to render them non-tight.

Above the watertight flat 17 another bulkhead module 368 with a pear-shaped opening 388 therein is positioned. The next innermost bulkhead module 390 at the second level can be fabricated as a single unit or as several sub-units as shown by sub-module unit 392. The bulkhead module 390 is constructed with an opening 394 in order to reduce the weight and to provide for fluid flow. Flange plates 388A and 394A are provided around the perimeter of openings 388 and 394. A reinforcing plate 396 is connected along the lower edge of the opening 394 and extends inwardly toward core peripheral wall 230. Another reinforcing plate 398 is provided along the plane of the upper edge of opening 394 for the same purpose. The bulkhead module 376 can have openings such as 400 and 402 for weight reduction.

A series of eight ice wall web frames 404 are arranged in circumferential positions along the inner vertical edges of the bulkhead module illustrated as 380. These web frames are non-tight superstructure support for ice walls 52 and 62 as further described with respect to FIG. 19. Another series of six ice wall web frames are then positioned at the innermost vertical edges of the bulkhead modules 382 and 386. This series of web frames 406 can be constructed so that the lower section 406B is identical to the web frames in the 404 series to lower construction costs.

The reinforcement girders 208 which are connected to the upper surface of base plate 186 are shown as having "t" top flanges which provide support base for a series of reinforcing girders 408 which are affixed to the various bulkhead modules 380, 382, 384, 386, 390 and 392. This series of reinforcing girders 408 is extended throughout the lower bulkhead modules 380, 382 and 384. A similar series of reinforcing girders 410 is provided for the bulkhead modules 386, 390 and 392. As seen by the double headed arrows in FIG. 14, these girders are placed so as to abut opposite positions on the upper and lower sides of the watertight flat 17.

The ice walls 52 and 62 are constructed as a steel/concrete composite as shown for the outer flange 50 where a series of spaced "t" reinforcing flange girders 412 are affixed to the outer vertical surfaces of wall 414 and the upper surface of sloped base support wall 416 of the support base outer flange 50 as shown in FIG. 11. A heavy layer of normal density concrete 418 is then utilized to form a steel/concrete composite by interlocking around the "t" flanges of the girders 412. This interlocking feature of the reinforcing flange girders 412 is an important feature of the ice walls and the load resisting properties are much greater than if these girders would be positioned on the underside of walls 414 and 416. The interlocking of concrete layer 418 with the girders 412 provides mutual strength increase.

The second sloped surface 62 is constructed in the same manner as the first sloped surface.

A preferred practice is to reinforce the outer column wall 80 by a series of "t" flange girders 422 which can pass through the non-tight bulkheads such as 376 and be interconnected at their ends against the liquid-tight bulkheads. In a similar manner, "t" girders can be employed as foundation elements 424 for the girders as shown just below the watertight flat 19.

The watertight bulkheads 212, 214 and 216 in FIG. 10 are illustrated by bulkhead 212 in FIG. 15 which rests on base plate 186. The base reinforcing "t" flange girders 208 are shown attached to the upper surface of base plate 186. These "t" girders provide support for the reinforcing vertical girders 430 which are centered on each of the "t" flange girders 208 along the entire radial length of the watertight bulkhead 212. These reinforcing girders 430 are interrupted by the watertight flat 17 as shown by the double headed arrows. Also a series of vertically spaced reinforcing stiffeners 432 are distributed throughout the planar surface of the watertight bulkhead 212. These stiffeners need to be placed on only one side of the bulkhead 212 as are the girders 430. Also the vertical spacing of these stiffeners 432 can be increased in the section of bulkhead 212 above the watertight flat 17 due to somewhat lower fluid pressure. The first sloped ice wall 52 and the second sloped ice wall 62 are described with respect to FIG. 14. The base of a watertight bulkhead extension 434 is also shown in FIG. 15 and corresponds to the non-tight bulkhead module 376 in FIG. 14.

Detailed Construction Of Ice Wall 52

The steel/concrete composite construction of ice wall 52 is an important feature of the present invention and is shown in the cut-away perspective section view in FIG. 16. The inner surfaces of the ice wall base plating 414 at the outer most position of flange 50 and the support plating 416 underlying the ice wall 52 on the top side of flange 50 are supported by the watertight bulkheads 206A and 206B shown in FIGS. 10, 14 and 15. On the outer surface of the ice wall base plating 414 and 416, the series of circumferentially spaced "t" flange girders 412 are attached with the "t" flanges positioned upwardly for providing mechanical interlocking to the concrete layer 418. A series of "inverted L" shaped stiffeners 436 are affixed to the upper surfaces of the wall plating 414 and 416 by welding and are formed with arcuate sections 438 for the curved toe section 440. Only two of these stiffeners 436 have been shown in FIG. 16 for clarity. It is understood that in actual construction these stiffeners are placed at approximately the intervals shown across the entire wall plating surfaces 414 and 416 of each of the frustrum base support sections. Openings 442 and 444, 446 and 448 are provided in the webs of the "t" girders 412 so that these girders can be fitted over the previously secured stiffeners 436. Also, a series of circular openings 450 are provided in the "t" flange girders in order to further enhance mechanical locking of the concrete layer 418 to the steel reinforcement structure and to reduce the possibility of having voids in the concrete.

A reinforcing mesh work 452 is then secured to the top surfaces of the flanges 454, 456 and 458 of the representative girders illustrated. This reinforcing meshwork is constructed of rebar and is welded in place on raised studs 460. The concrete layer is then formed by pouring the concrete in over the preestablished steel reinforcing structure so that the concrete flows downwardly into and around the "inverted-L-shape" of the base stiffeners 436, the openings 450 and under the flanges 454, 456 and 458 of the girders and also in and around the reinforcing meshwork 452. The pouring of the concrete is accomplished by means of a slip-forming technique which will be further described below in reference to FIG. 26.

The resulting steel/concrete composite ice wall 52 is thus formed with exceptional ice impact force distribution properties such that multi-layer pressure ice ridges can be broken by out-of-plane bending fracturing without rupture or permanent deformation of the ice walls.

Other features of the outer flange 50 shown in FIG. 16 include the vertically positioned "t" flange girders 430 which are positioned on the top flanges of the bottom reinforcing girders 208. The vertical reinforcing girders 430 are rigidly attached by welding to the bulkheads 206. A series of flat reinforcing chocks 462, 464 and 466 positioned between the adjacent bottom reinforcing girders 430 are shown in FIG. 16. The purpose of these reinforcement members is to provide the spaced "t" flange girders in the ice wall 52 with the additional reinforcement and to transfer loads into the bulkhead 206. As shown, the ice wall girders 412 are reinforced on the undersurface of the support plating 416 by either the "t" flange girders 430 or the flat chocks 462–466. Also shown in FIG. 16 is a detailed view of a single radially arranged base stiffener 210A which is welded to the upper surface of base plate 186 and passes under the circumferentially arranged stiffening girders 208 by means of openings 468–474 formed in the webs of the girders 208.

The construction of the support base 16 as described with respect to FIG. 16 requires considerable welding fabrication. The stiffeners and girders must all be welded into secure positions against the various plating and bulkheads and to one another. This requires a structure open enough to provide for convenient welding spaces. If a steel/concrete composite ice wall such as described with respect to FIG. 16 were not utilized but rather a steel plating outer skin of about 2 inches thickness were employed, the underlying reinforcement girder system which would be required would be so tightly spaced that the welding could not be accomplished without great difficulty and it would be economically unjustified to attempt such construction. This would mean that the vertical members 430 and 462, 464 and 466 illustrated in FIG. 16 would have to be so close together to resist the high force loads applied to the outer surface of such steel plating, that the necessary welding would be exceedingly difficult, time consuming and costly.

The height, h, of the flange outer wall 414 is of significance to the force distribution properties of ice wall 52. The height, h, determines the total superstructure force bearing capacity of the ice wall 52 in the various frustum sections 150–180. For multi-year ice ridges, h should be between about 3 to 6 meters and preferably 4 meters. For operation in greater water depths, h could be increased. The ratio of h to the outer flange 50 annular width A (FIG. 5A) preferably is at least as great as about 0.15 for structural integrity. The upper limit of this ratio depends upon the water depth in which the structure is to operate. For water depths of the range of 25 to 65 feet, the ratio preferably is not more than about 0.40; for water depths in the range of 65 to 150 feet, the ratio preferably is not more than about 1.0. These ratio ranges are selected to achieve optimum ice impact resistance for the structure 10.

Figure 17:
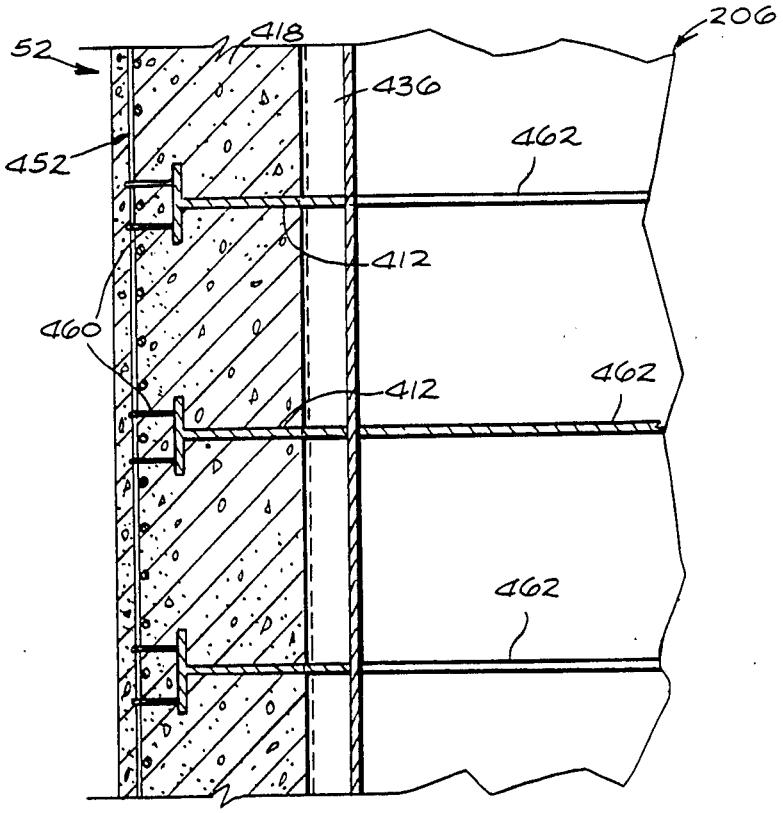
FIG. 17 is a detailed cross-sectional view of the ice wall construction shown in FIG. 16 taken on line 17—17.
Figure 18:
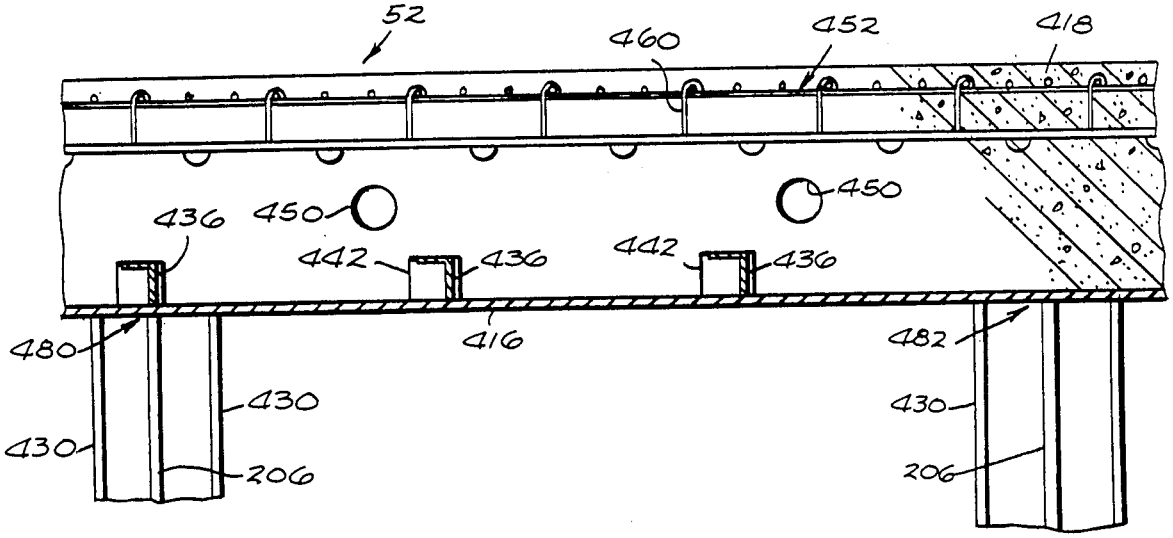
FIG. 18 is a detailed cross-sectional view of the ice wall of FIG. 16 taken on line 18—18.

FIG. 17 shows the detailed construction of ice wall 52 taken along the section line 17—17 in FIG. 16. As seen in FIG. 18 the spaced non-tight bulkheads 206 have "t" flange girders 430 positioned on either side thereof to provide for double reinforcement at the juncture areas 480 and 482 for the two bulkheads shown. As an alternate, the girder 430 could be increased in size and be positioned on only one side of the bulkheads 206. The positioning of the bulkheads 206 is such that one of the reinforcing stiffeners 436 immediately overlies the upper end of bulkhead 206 on the opposite side of the base plating 416.

Figure 19:
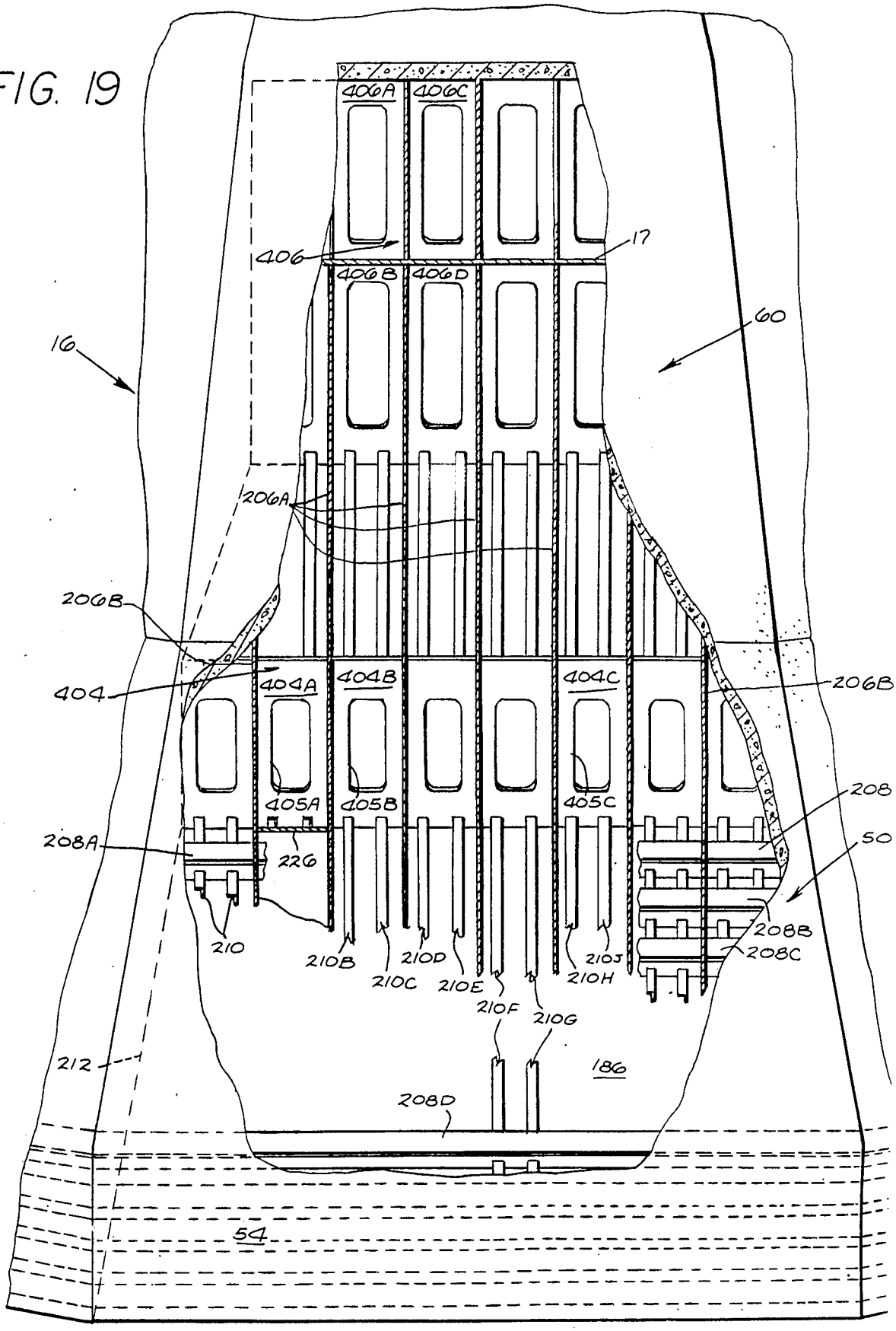
FIG. 19 is a detailed perspective cut-away view of a segment of the first and second sloped surfaces of the marine operations structure of the present invention showing the internal reinforcing radial and circumferential bulkheads.

The partially cut-away perspective view of a portion of base support 16 in FIG. 19 shows the placement of the ice wall web frame 404 under the juncture of slope ice wall 52 and second sloped ice wall 62 (see also FIG. 14). Also, the taller ice wall web frame 406 is shown supporting the second sloped surface 60. The first of these web frames is made up of separate web frame modules 404A, 404B and 404C as illustrated. Each of these modules is constructed with openings 405A, 405B and 405C as illustrated to permit the flow of sea water ballast between the space under the first ice wall 52 and the space under the second ice wall 62. In a similar fashion, the ice wall web frame 406 is formed from similarly shaped web modules 406A and 406B which are stacked vertically with the watertight flat 17 interposed therebetween. The adjacent module set 406C and 406D is arranged on the other side of the non-tight radially positioned bulkhead 206B. Other radially-positioned bulkheads 206A are positioned between web frame modules as shown. The resulting combination of ice wall web frames and non-tight bulkheads positioned at about three meter spacing provides the primary supporting superstructure for ice walls 52 and 62. In addition to the non-tight or swash bulkheads, reinforcement girders such as described with respect to FIGS. 14 and 16 are also employed.

As seen in FIG. 19, the radially arranged stiffeners 210 and enumerated 210B–210J are affixed to bottom plate 186 and are positioned under the web frames 404 and 406. For clarity in FIG. 19, only two of the stiffeners of the five stiffener sets shown as numeral 210 in FIG. 10 have been illustrated. The circumferentially positioned "t" girders 208A, 208B, 208C and 208D are also shown affixed in an overlying position to the stiffeners 210. These reinforcing girders 208A–208D are affixed to the top surface of bottom plate 186 and are positioned to abut the lower portions of the non-tight bulkheads 206.

Figure 20:
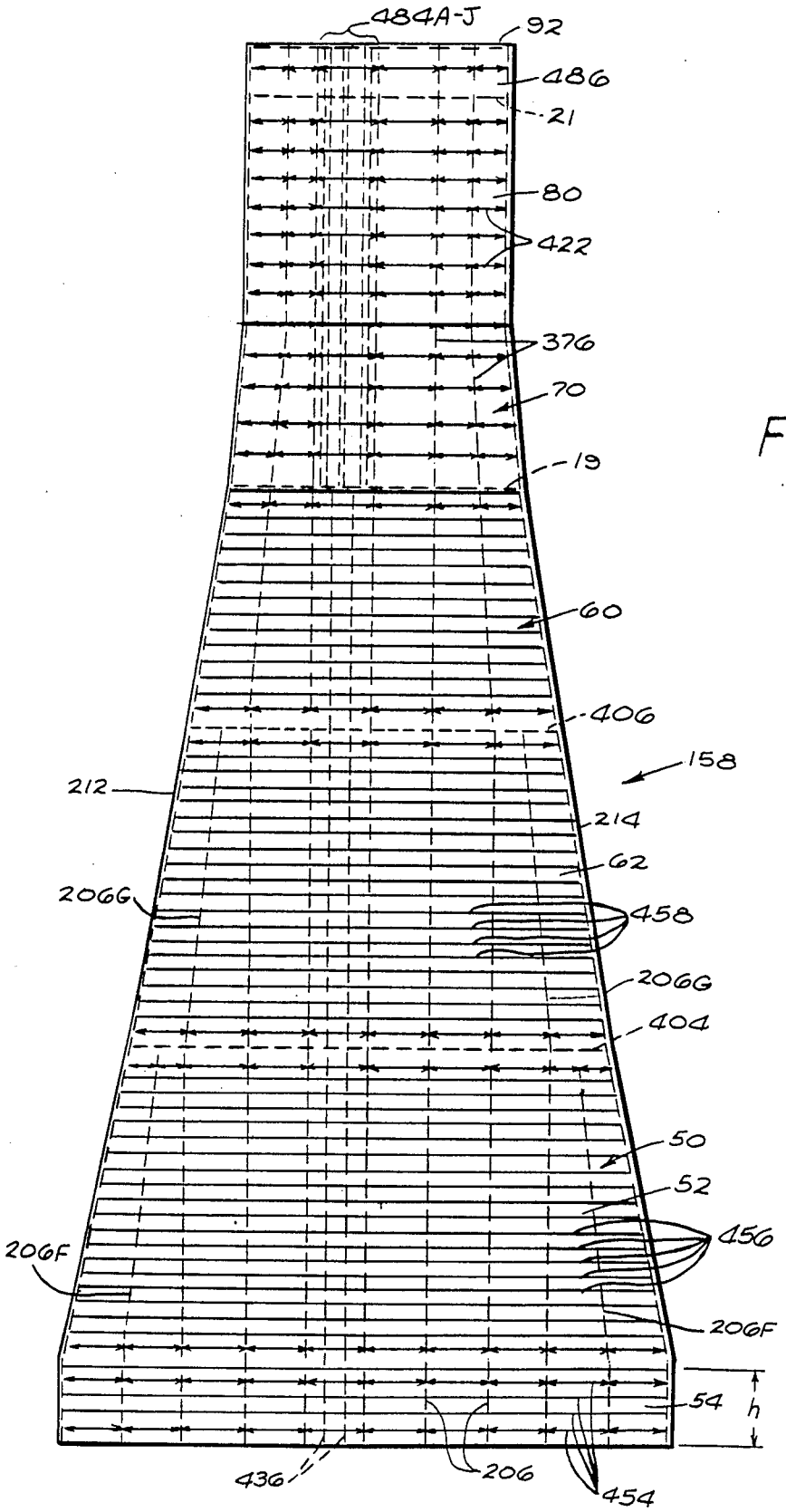
FIG. 20 is a planar layout diagram of the reinforcing members in one of the sixteen segments of the support base of the structure of the present invention taken along line 20—20 in FIG. 14.

FIG. 20 shows a schematic planar layout of the base support segments 158 along line 20—20 in FIG. 14 and thus, illustrates the relative positioning of the supporting superstructure for ice walls 52 and 62. The "t" flange girders 454, 456 and 458 are shown underlying the entire outer flange surface 54 as well as the ice walls 52 and 62 up to the point where the second ice wall 62 engages the skirt 70. The radially arranged ice wall stiffeners 436, which are distributed along the entire width of segment 158, are illustrated by the two dashed lines. The partial length non-tight bulkheads illustrated as 206B are also shown underlying the first ice wall 52. The ice wall web frames 404 and 406 are shown at their respective positions. The watertight bulkheads 212 and 214 are shown positioned along either side of segment 158.

The vertical reinforcing bulkheads 376 are shown as extensions of the central non-tight bulkheads 206 and extend upwardly to provide superstructure support for skirt 70 and central column exterior surface 80. Between these spaced bulkhead members are a series of nine stiffeners illustrated by dashed lines and designated as numerals 484A–484J. The watertight flat 21 which forms the bottom surface of oil storage tank 486 is shown at the top of FIG. 20, as is the cellar deck 92.

Ice Impact Properties Of Ice Walls 52 and 62

The novel steel/concrete composite ice walls 52 and 62 together with their supporting superstructure as described above, are capable of withstanding extremely high ice loading over small areas without fracturing or deformation. These ice walls distribute the puncture-shear and ice crushing forces over large areas which are supported by the internal superstructure of the support base 16. The ice walls are also capable of withstanding somewhat lower ice loadings over much larger areas. These load resisting characteristics of the base support 16 and the first and second sloped ice walls 52 and 62 are sufficient to resist the impact of multi-year ice features. Such features have crushing strengths which can cause deformation of steel plating when used as an ice wall.

Figure 21:
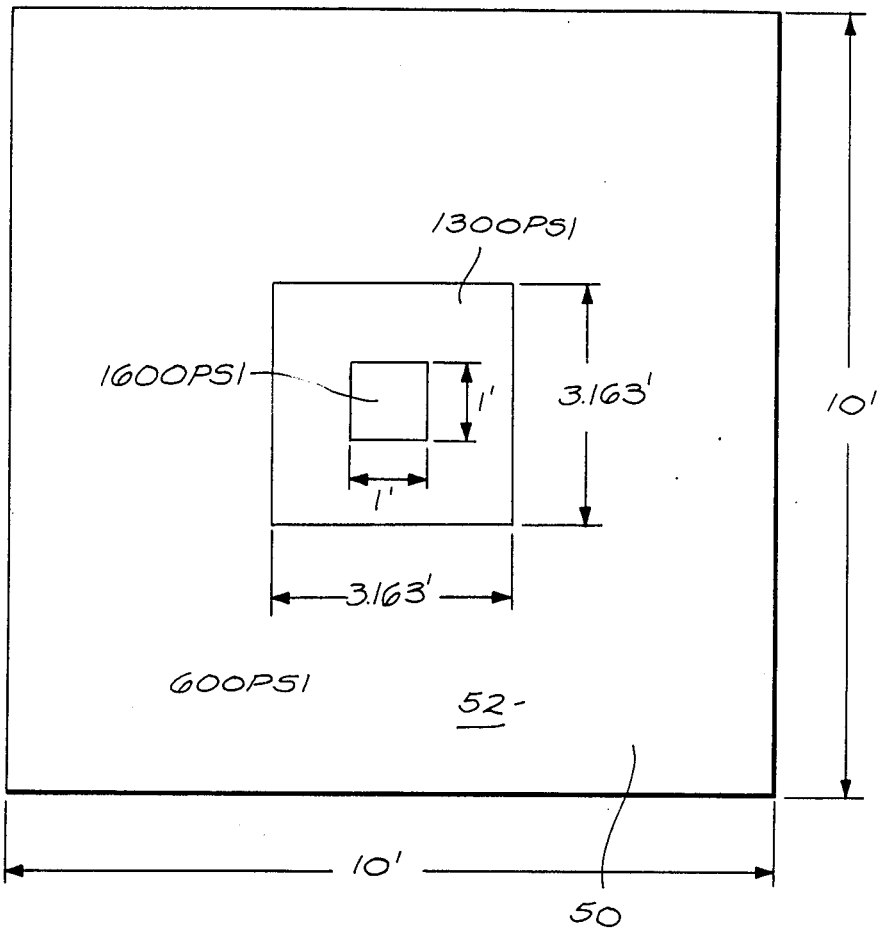
FIG. 21 is a planar schematic diagram of a 100 square foot section of the ice wall in the first sloped surface showing the variable surface strength thereof within the given areas.

In such multi-year ice features the uniaxial compressive or crushing strength of ice ranges from about 500 to 1,200 pounds per square inch. Because of confinement, over a small area the ice is capable of a pressure in excess of its uniaxial compressive strength. Therefore, to maintain integrity, an ice wall must be capable of counteracting high local pressure from the ice. On the broader scale, the large force of from about 100 to 200 million pounds exerted by a multi-year pressure ice ridge is distributed over much larger surface areas which do not encounter constant crushing force from the ice. FIG. 21 shows the force distribution of strengths for ice walls 52 and 62. For a one square foot section, the design pressure is 1,600 psi. For a 10 square foot section of the ice wall, the design pressure is 1300 psi. For a 100 square foot section of the ice wall, the design pressure is 600 psi. Based on information available at this time, this strength distribution is sufficient to withstand multi-year ice features of the type described with respect to FIG. 2. If additional information becomes available which causes changes in the design ice pressures, then the dimensions of the ice wall components and the supporting members can be altered as required.

Horizontal Sections Of Structure 10

Figure 22:
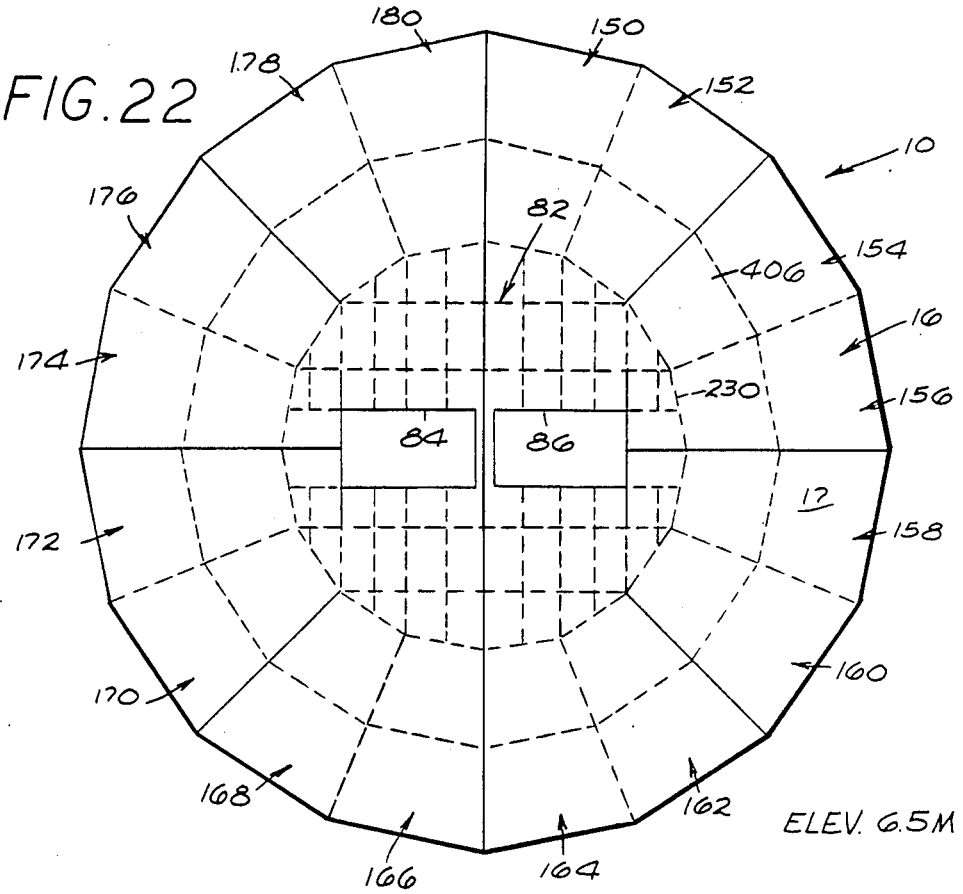
FIG. 22 is a top schematic view of the lower portion of the marine structure of the present invention taken at a vertical elevation plane intersecting the support base showing the relative placement of the major radial and circumferential reinforcing bulkheads and the two rectangular moon pools in the central core.
Figure 23:
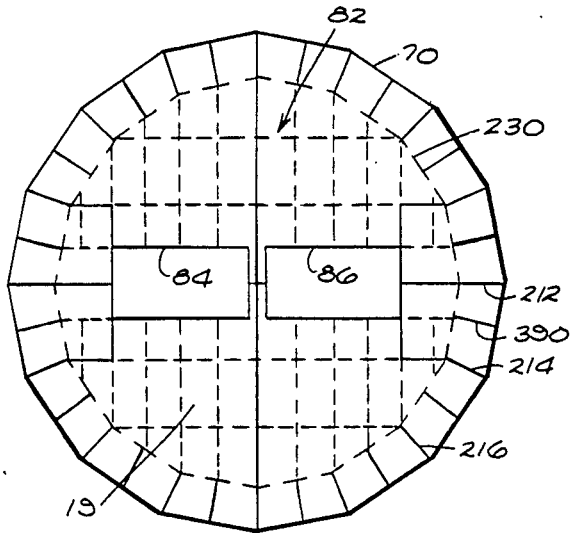
FIGS. 23 and 24 show the reinforcing structure of the central core at different vertical elevations.

The layout of structure 10 at the vertical level of the watertight flat 17 is shown in FIG. 22. The layout at the elevation of watertight flat 19 is shown in FIG. 23. The layout on watertight flat 21 is then shown in FIG. 24.

FIG. 22 shows the watertight flat 17 supported by the underlying ice wall web frame set 406 in each of the base support segments 150–180. This watertight flat 17 is also supported by the system of watertight and non-tight bulkheads and reinforcing decks within central core 82 as described with respect to FIGS. 8–12A. The rectangular moon pool openings 84 and 86 are also shown. FIG. 23 shows watertight flat 19 supported by the inner most portions of the fluid-tight bulkheads 212, 214 and 216 as illustrated for the lower right quadrant. These bulkheads provide support for the outer edges of the watertight flat 19 along with the non-tight bulkheads 390 as illustrated by the single enumerated bulkhead positioned between the watertight bulkheads 212 and 214. As seen in FIG. 10 there are five of these non-tight bulkheads positioned between each of the watertight bulkheads. The system of bulkheads in central core 82 is also seen underlying watertight bulkhead 19.

Figure 24:
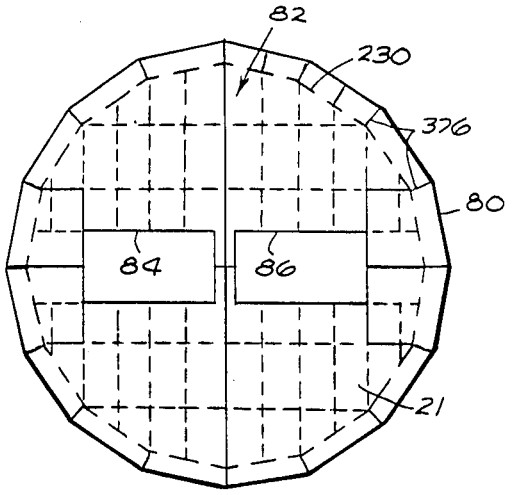

In FIG. 24 the oil tight flat 21 is shown supported mainly by the system of watertight and non-tight bulkheads within the central core 82. The peripheral portions are also supported by the structural bulkheads 376 shown in FIG. 14 which are positioned on top of the water-tight and non-tight bulkheads denoted as 206, 212, 214 and 216 in FIG. 10. The number of these structural bulkheads corresponds to the number of water-tight and non-tight bulkheads shown in FIG. 10 for each of the sixteen segments shown at the periphery of FIG. 24.

Resistance To Overturning

Figure 25A:
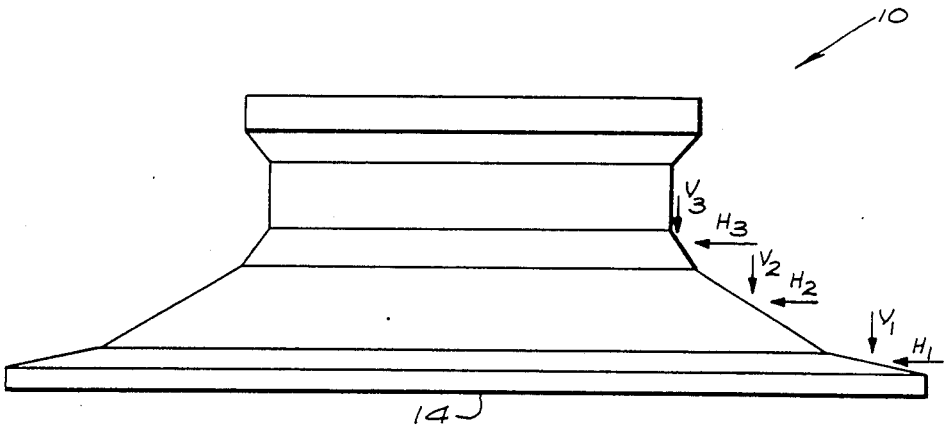
FIGS. 25A and 25B are schematic diagrams of the present invention showing the forces acting on the structure and generating over-turning moments.
Figure 25B:
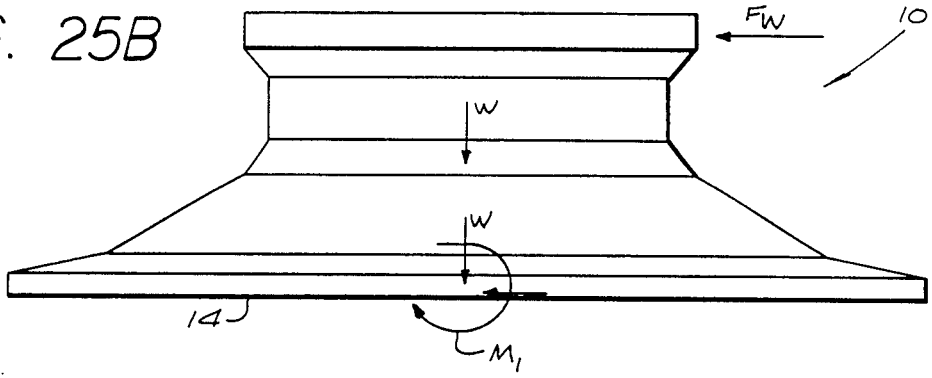

FIG. 25A shows the primary ice forces action upon a structure 10 during the failure of a multi-year ice ridge embedded in a multi-year ice floe. The forces $H_1$ and $V_1$ represent the horizontal and vertical forces applied to the structure during the failure of a multi-year ridge. The horizontal and vertical forces $H_2$, $V_2$, $H_3$ and $V_3$ represent the ride-up and clearing forces on the structure applied by the multi-year ice floe. This system of forces can be equated to a statically equivalent horizontal and vertical force $H_I$ and $V_I$, and a moment $M_I$ all acting on the bottom of base 14 at its geometric center, as shown in FIG. 25B. The horizontal ice force $H_I$ is equal to the sum of $H_1$, $H_2$ and $H_3$, and is in the order of 30 million to 130 million pounds. The vertical ice force $V_I$ is the sum of $V_1$, $V_2$ and $V_3$, and is in the order of 50 million to 250 million pounds. The ice moment $M_I$ is the sum of the moments $V_1$, $V_2$, $V_3$ and $H_1$, $H_2$, $H_3$ about the geometric center of the bottom of base 14. The horizontal forces $H_1$, $H_2$ and $H_3$ cause moments which act in the counter-clockwise direction. The vertical forces $V_1$, $V_2$ and $V_3$ cause moments which act in the clockwise direction. Because of the geometry of the structure 10 and the magnitude of the forces, the resultant ice moment $M_I$ will be in the clockwise direction as shown during the failure of a multi-year ice ridge imbedded in a multi-year ice floe. The resultant ice moment $M_I$ is in the order of 10 to 60 billion foot-pounds.

Also shown in FIG. 25B is the force W. This force represents the force the ballasted weight of the structure applies to the seabed. The force W is found by subtracting the displacement of the structure 10 in its operating water depth from the weight of the structure 10 in air. The force W is in the order of 200 million to 400 million pounds. Also shown in FIG. 25B is the wind force $F_W$ applied to the structure 10. The wind force $F_W$ is in the order of 1 million to 2 million pounds.

As a first approximation the pressure on the soil due to the forces and moment shown in FIG. 25B can be calculated by assuming that the unit 10 is rigid and that the soil reacts as a linear elastic material. The maximum pressure on the soil obtained from such a calculation is in the order of 2,000 to 6,000 pounds per square foot. A more accurate analysis which includes the force-deformation characteristics of the structure 10 will give results in which the maximum pressure on the soil is somewhat reduced when compared to the results from an analysis with the structure 10 assumed to behave as a rigid body.

The pressure bearing characteristics of the shallow soils must be such that the maximum pressure on the soil can be withstood with an adequate factor of safety. In addition, the horizontal ice force $H_I$ causes a shear stress to be applied to the soil under structure 10. Beneath the base plate of 14, skirts 196 have been provided to ensure that a shear failure of the soil must occur for the structure 10 to be displaced horizontally from its position over the well site. The shear strength of the soil must be such that the shear stress in the soil caused by the horizontal ice force $H_I$ can be withstood with an adequate factor of safety.

A problem can be encountered when the structure 10 is positioned in deeper water at depths such that the multi-year ice ridges cannot be uplifted and fractured on the first sloped surface but rather would encounter the second sloped surface. Because the slope of the second sloped surface is greater than that of the first sloped surface, this has the effect of increasing the horizontal force required to cause a failure of the multi-year ice ridge and causing the force bearing characteristics of the subsoil in horizontal shear resistance too possibly be exceeded.

Figure 25C:
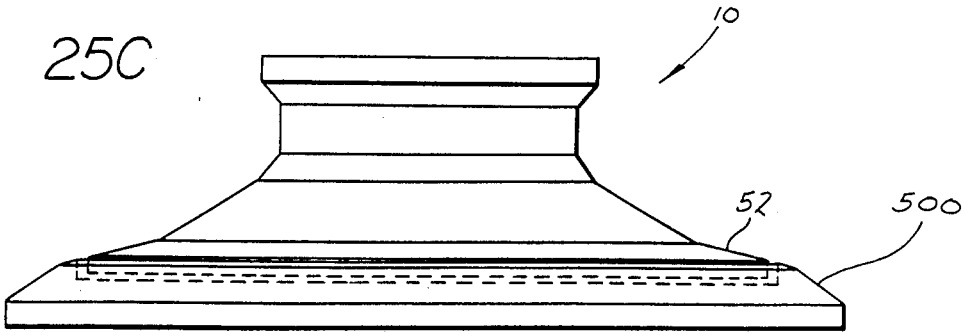
FIG. 25C is a schematic diagram of the structure of the present invention installed on a base berm.

In order to overcome this difficulty and to provide for stable operations in greater water depths, a structural berm 500 can be employed as shown in FIG. 25C. Such a berm is further described with respect to FIGS. 27 and 28.

The berm 500 has the effect of elevating the structure 10 to the preferred height for optimum failure of multi-year ice features. The multi-year ice ridge is now encountered by the first sloped ice wall 52 for out-of-plane bending and fracturing.

With the berm 500 in place, the horizontal and vertical ice forces required to fail an ice feature consisting of a multi-year ice ridge embedded in a multi-year ice floe are the same as would be required to fail the same feature in shallower water without use of the berm. Because of the geometry of the structure 10 and the magnitude of the ice forces, the moment due to the forces about the center of the bottom of the berm is less than the amount about the center of the base 14 of structure 10. The base area of berm 500 is substantially greater than the base are of structure 10. Also, for the same ice feature, the same horizontal ice force is applied to the structure 10 with berm 500 as is applied to the structure 10 without use of the berm in shallower water. Hence, the horizontal shear stress applied to the soil is reduced. The vertical load on the seabed due to the weight of the unit consisting of structure 10 and berm 500 is equal to the ballasted weight of the berm minus its displacement, plus the weight of the gravel in the central recess minus its displacement, plus the ballasted weight of structure 10 complete with equipment minus its displacement at the operating water level. The amount of ballast in the structure 10 and the berm 500 can be adjusted to cause the vertical load on the seabed to be less than, equal to, or greater than the fully ballasted load on the seabed of the fully ballasted structure 10 used alone in shallower water depths. Because of the foregoing, and because the base area of berm 500 is substantially larger than the base area of structure 10, it can be seen that the maximum pressure on the seabed caused by the weight and ice forces on the unit comprised of structure 10 plus berm 500 can be less than the maximum pressure on the seabed caused by the failure of the same ice feature against structure 10 alone operating in shallower water. Therefore, structure 10 with the addition of berm 500 can operate in deeper waters, and resist the same size ice features, while resting on soils with weaker force resisting characteristics. Or conversely, the structure 10 with the addition of berm 500 can operate in deep waters, resting on equally competent soils, and be able to resist ice forces from larger ice features.

Fabrication Of Ice Walls 52, 54 And 62

Figure 26:
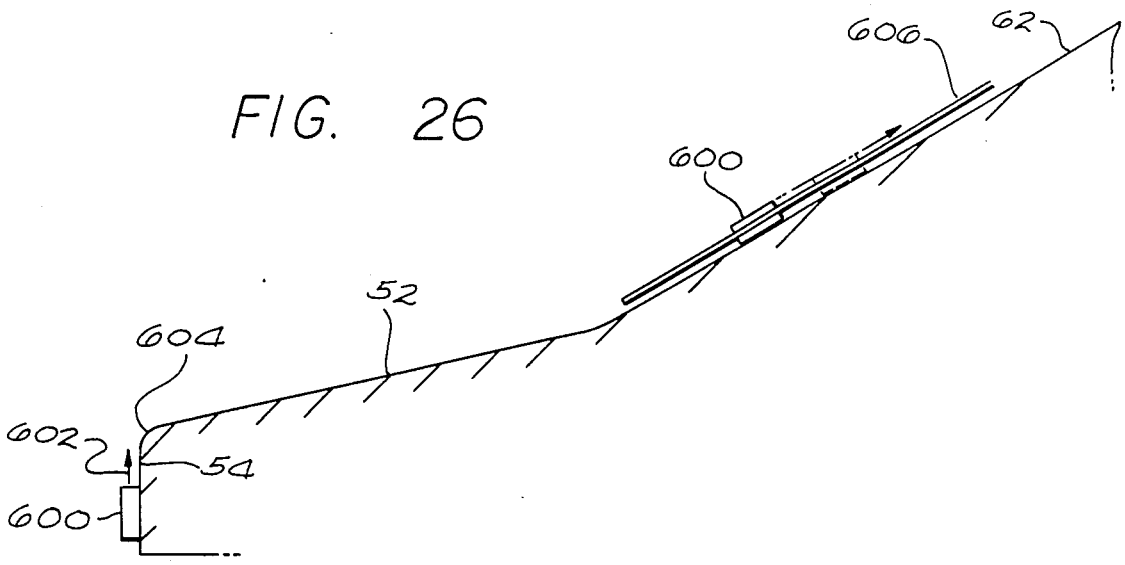
FIG. 26 is a schematic view of a simplified slip-forming construction technique used for fabricating the ice wall of the present invention.

FIG. 26 shows the preferred slip-forming fabrication technique used for constructing ice walls 52, 54 and 62. The structure 10 is fabricated with central core 82 and the surrounding base support 16. The watertight and non-tight bulkheads of support base 16 are built up with the above-described reinforcing girders and flats as shown in FIG. 16. Next the ice wall base plates 414 and 416 are installed with the curved toe portion 440. The outer stiffeners 436 are then placed on the plating and the overlying "t" flange girders, and the reinforcing grid system 452 is installed. Once this superstructure and reinforcing grid is in place, a slip-form 600 is installed in front of the outer wall 54. Concrete is then poured between the slip-form and the superstructure and the slip-form is slowly moved upwardly as indicted by arrow 602 to form the vertical front wall 54. A curved slip-form (not shown) can then be employed to form the outer curve 604 between the ice walls 52 and 54. The first and second sloped ice walls 52 and 62 are then concrete filled by placing a slip-form 600 between temporary parallel rails shown as rail 606 and moving it slowly upward in order to create a smooth ice wall surface. This fabrication technique is found to be a low cost and fast method for constructing the novel steel/-concrete composite ice wall.

Base Berm

Figure 27:
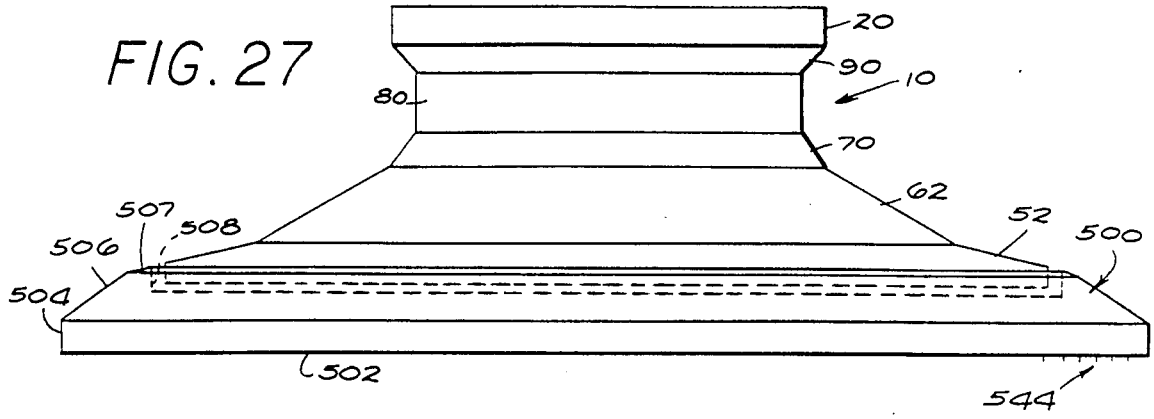
FIG. 27 is a schematic view showing the intraction of the structure of the present invention with a base berm.
Figure 28:
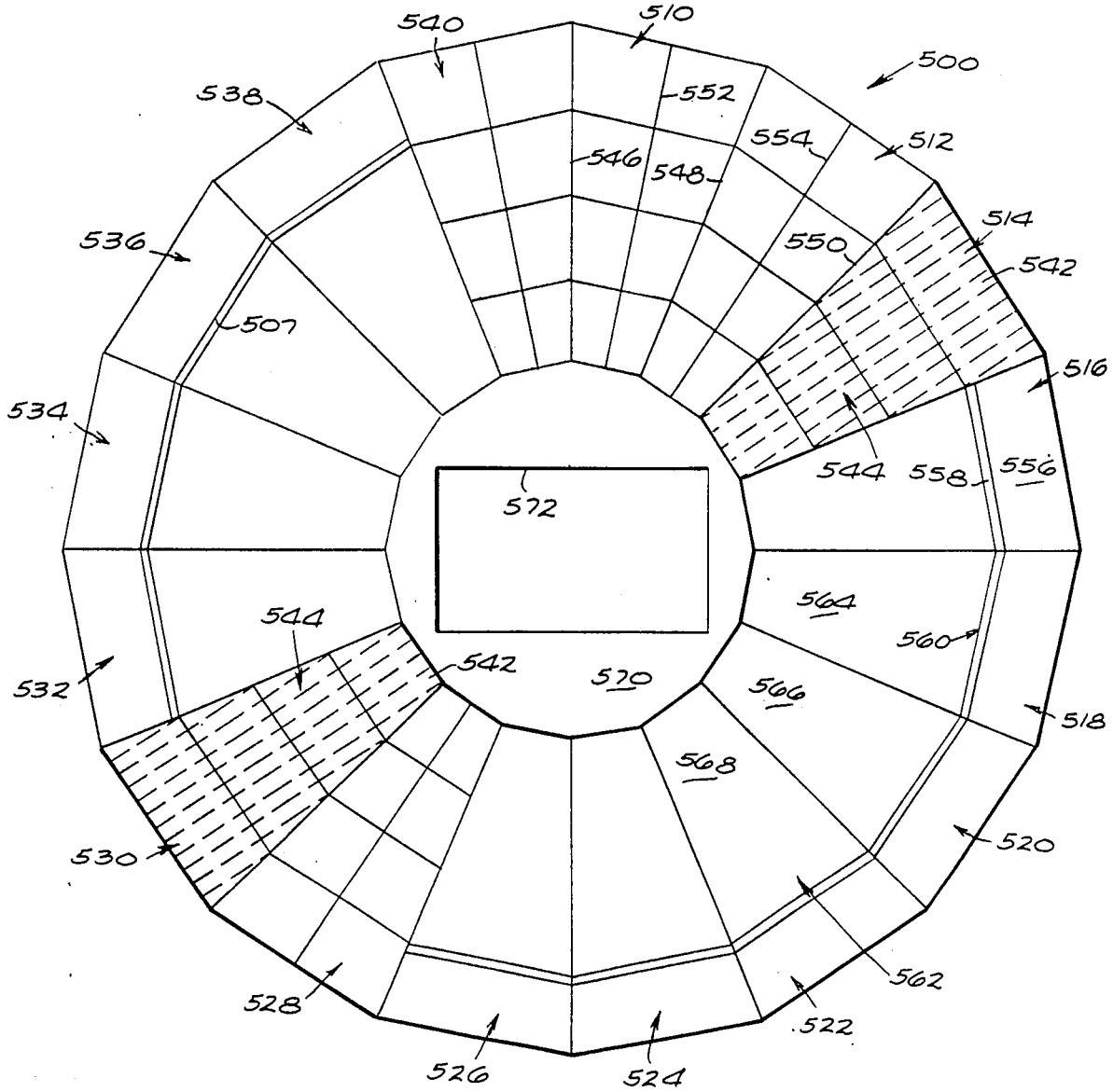
FIG. 28 is a top plan partially cut-away view of a base berm.

FIGS. 27 and 28 show the berm 500 on which the structure 10 can be installed in deep waters. The basic form of the berm 500 is a large "saucer" shape having a base 502, vertical side walls 504, two inclined walls 506 and 507, and a recessed central section 508. As an alternate configuration, berm 500 may have zero or one sloped surface. The shape of the beam 500 then corresponds to the sixteen sided configuration of structure 10. Thus, sixteen separate frustum sections 510–540 are formed as shown in FIG. 28.

A base plate 542 is laid down in one or more sections and then a grid work of skirts 544 that is installed on the under-surface of plate 542. These skirts have the same construction as shown in FIG. 10A for structure 10. On the top surface of base plate 542, a series of watertight bulkheads 546, 548 and 550 are constructed to conform to the vertical shape as shown in FIG. 27. Between these watertight bulkheads additional centrally located radial non-tight bulkheads 552 and 554 are positioned as shown in the upper right quadrant of FIG. 28. This type of internal bulkhead construction is employed for each of the frustrum sections 510–540. The individual walls for frustum section 516 are shown as outer sloped wall 556 and edge wall 558 in FIG. 28. An interior wall 560 then forms the recessed portion 508 shown in FIG. 27. An internal base deck flat is then formed in sections illustrated as 564, 566 and 568. A central section 570 is on the same plane as sections 564–568 and is formed with a single large moonpool 572 which extends through the berm 500 with watertight walls. Moonpool 572 may be rectangular as shown, or may be a sixteen-sided polygon.

The sloped wall 506 and specifically 556 of segment 516 can be constructed from a steel/concrete composite ice wall as shown with respect to structure 10. In the preferred form as shown in FIGS. 27 and 28, this type of ice wall has not been employed since the berm will generally be used in waters at depths which will not encounter the multi-year ice ridges.

The central recess 508 is filled with a gravel or other solid ballast material and then the structure 10 is installed so that the skirt pattern 194 shown in FIG. 10 penetrates the gravel or solid ballast. In this manner the internal shear resistance within the gravel or ballast layer prevents the edges of structure 10 from impacting against the inner walls 560 of recess 508. The structure 10 and the berm 500 are thus sufficiently locked together to prevent horizontal sliding off station. The underlying skirt pattern 544 of the berm 500 thus prevents slippage in the soft sea floor and assures that any horizontal movement will be due to shearing in the sea bottom soil.

The use of a gravel interlayer between structure 10 and berm 500 permits the refinement in practice of selecting a gravel or ballast particulate material which has the appropriate material properties.

The preferred outer flange height, h, of structure 10 is 4 meters and the preferred first sloped surface 50 angle, alpha, is 13° and second sloped surface 60 angle, beta, of 30° results in structure 10 being fully usable in water depths of between 25 feet to 65 feet. (See also FIG. 5A) By use of berm 500 the depth range can be raised to 100 feet or more.

The preferred berm thickness over the area of recess 508 is 40 feet, but this can be varied for various water depths to achieve optimum soil loadings taking into consideration the multi-year ice features which must be resisted, and the force bearing and shear characteristics of the subsea soils in the area in which the unit will operate.

Installation And Relocation Of Marine Operations Structure

The internal comstruction of operations structure 10 as described herein forms a series of sixteen, lower-level, frustum-shaped, fluid-tight, ballast tanks in the support base 16 over which the first sloped surfaces 50 are positioned. The lower level series of tanks are illustrated by the two diametrically opposed tanks 620 and 622 in FIG. 29. The central core perimeter wall 230 is a fluid-tight bulkhead and separates the outer series of tanks 620 and 622 from the lower level central core tanks 624 and 626. There are four quadrant-shaped ballast tanks in the lower level central core. The fluid-tight flat 17 divides these lower level ballast tank series in the support base 16 and central core 82 from the upper level ballast tanks shown as 628 and 630 which underlie the second sloped surface 60. These two ballast tanks are representative of a second set of sixteen frustum-shaped tanks having the configuration shown.

Within central core 82 and a fourth ballast tank set illustrated by tanks 632 and 634 are positioned on either side of moon pool 84. This moon pool is surrounded on two sides by the ballast tank 632 as shown by extension 636. A similar extension 638 for ballast tank 634 is also shown.

The liquid-tight flat 19 and the central core perimeter wall 230 together with the upper liquid-tight flat 21 form an upper fifth set of ballast tanks 640 and 642 which are quadrant shaped in a horizontal plane as are the lower series of central core tanks illustrated by ballast tanks 632 and 634.

Between the fluid-tight flat 21 and the cellar deck 92 a series of four quadrant shaped oil tanks illustrated as tanks 644 and 646 are provided. If desired additional fluid storage tanks ban be formed above the cellar deck 92 and two such tanks 650 and 650 are illustrated for operating fluids storage.

Also shown in FIG. 29 are the casing storage compartments 654 and 656 and drilling mud and cement bulk storage tanks 658.

In operation, the lower level series of tanks illustrated as 620, 622, 624 and 626 are ballasted with sea water in a diametrically opposed and sequential fashion explained below with reference to FIG. 31. Also, the sixteen frustum shaped intermediate level tanks illustrated as tanks 628 and 630 are also ballasted with sea water in the same diametrically opposed fashion in order to set the structure 10 down on the sea bottom. After this has been accomplished and the positioning of structure 10 adjusted slightly if required, the central core tanks illustrated as 632 and 634 at the intermediate level and 640 and 642 at the upper level are then additionally flooded to increase the resistance against horizontal sliding of the structure 10 upon impact with ice features and particularly multi-year pressure ice ridges.

In FIG. 30 the towing operation for mobile structure 10 is shown wherein three tug boats 660, 662 and 664 are connected to structure 10 at positions A, B, C and D as shown by tow lines 666, 668 and 670, respectively. Tow line 670 is connected at point A and tow line 666 at point B. Tow line 668 is connected to points C and D by a pair of lines 667, 669, with the lines 667, 669 preferably joined at an included angle of about 30°. In an alternative configuration, three connection points may be arranged within a 180° arc around the structure 10. The connection points can be located on the main deck 20 near its periphery, or alternatively around the central core of the structure. Tug boats of approximately 20,000 horsepower rating are sufficient for this purpose. The tow lines are approximately 1,000 feet in length. Each tow line consists of a length of wire rope connected to a length of chain. The free end of the wire rope will be connected to the structure 10. The free end of the chain will be connected to the tug boat. The towing configuration illustrated in FIG. 30 is commercially acceptable for achieving reasonable transit speeds. The light ship weight of structure 10 without the full operational supplies loading is 80,000 short tons and the structure draft during towing transit is 16 feet. With supplies for 5 wells of 15,000 feet each, the draft is increased to 18 feet.

When the operation structure 10 has arrived at a given sea location, the tug boats 660, 662 and 664 are repositioned so that the tow lines 666, 668 and 670 are at approximately 120° with respect to one another about the perimeter of the installation site. The tub boats are forward anchored as shown by anchors 672 and 674 in the case of tug boat 662. The final positioning is achieved by means of power winches mounted on each of the tug boats. The lower-level, frustum-shaped, liquid-tight tanks under each of the base support segments 150–180 are then flooded in a sequential manner to provide increased ballast for operation structure 10. The sequencing of ballasting in the lower level tanks illustrated in FIG. 29 as tank 620 and 622, is carried out by selecting a given start tank, for example, the tank within segments 150. Next the diametrically opposed tank within section 166 is filled with water. Next the tank within segment 152 is filled with sea water and then the diametrically opposed tank 168. The next sequential pair are the tanks within segments 154 and 170. This pattern is continued until the last of the diametrically opposed tanks beginning within segment 164 and its opposite tank underlying segment 180 are filled.

After the perimeter tanks are filled in the lower level the four ballast tanks illustrated by tanks 624 and 626 in central core 82 are then filled utilizing a simplified diametrically opposed filling sequence. The next tank series to be ballasted with sea water are those in the perimeter positioned intermediate level tanks illustrated as 628 and 630 in FIG. 29. These intermediate level tanks are then filled with sea water in the same sequential filling fashion as described with respect to FIG. 31 above. At this stage during the filling of the last of these tanks the gravity weight of structure 10 is sufficient to overcome the buoyancy force of the structure and continued filling results in the sinking and founding on the sea floor of the structure 10 in a water depth of 65 feet.

At this stage in the installation procedure the exact positioning of the structure 10 is recalibrated and any required adjustments are then made by means of deballasting the intermediate level tanks, in part, sufficient to cause the buoyancy forces to nearly equal the gravity forces so that the power winches aboard the tugs 660–664 can slide the structure 10 in one of the three directions shown in order to achieve the slight positional adjustments.

When the exact portion has been secured the central core intermediate level tanks 632 and 634 are then ballasted with sea water followed by ballasting, when desired, of the upper level central core tanks 640 and 642 as shown in FIG. 29. Since there are four such tanks at each of these levels a modified sequential filling procedure is also employed for these tanks. The large volume of sea water utilized in central core 82 in these tanks which are above sea level provides additional ballast for resistance to sliding upon the impact of any ice features.

The total ballast capacity described above is about 280,000 tons.

When relocation of operation structure 10 is desired, a reverse order of deballasting the tanks is employed as was above described for the ballasting procedure. That is, the central core upper level tanks illustrated as tanks 640 and 642 are deballasted followed by deballasting of the central core intermediate layer tanks 632 and 634. At this point, in a water depth of 65 feet, the buoyancy forces nearly equal the gravity forces and the intermediate level peripheral tanks illustrated as 628 and 630 in FIG. 29 are then set into a deballasting mode utilizing diametrically opposed deballasting sequencing. This procedure soon causes the buoyancy forces to exceed the gravity forces and the structure 10 will begin to rise. Before the rise occurs the tow lines 666, 668 and 670 are attached to the structure 10 and the tugs deployed as shown in FIG. 31. It is also a preferred practice to fit structure 10 with hydraulic or pneumatic jetting lines by which high flow rates of water or air can be pumped under the skirts 194 to aid break-out.

Continue deballasting of the intermediate level peripheral tanks, followed by deballasting of the central core tanks 624 and 626, and then followed by the sequential deballasting of tanks 620 and 622 results in the operations structure 10 again rising and becoming mobile with a transit draft of between 16 to 18 feet including the 2 feet lower extensions of the foundation skirts below the base 14.

The tow bridle system shown by the use of the three tow lines 666, 668 and 670 in FIG. 30 requires connection means at each of points A, B, C and D. Typically a pad eye is provided at the main deck level at each location, with a cooperating tow bit joined to the pad eye through a release bolt by which the associated tow line can be released from pad eye.

Flotation Dock System

FIG. 32 shows a floating ramp system 700 which is attached to the skirt portion 70 through pivot connection 701. A large structural bracket consisting of two or more bracket ears illustrated as 702 are provided for this attachment. A ramp 704 is supported by a base framework 706 and is connected at its outer end 708 to a float 710 by a suitable pivotal connection 712. Access to the ramp 704 may be through a manhole access at the bottom of a passage trunk up the outside of the central core perimeter wall 230 to the main deck 20.

In use, a supply boat can approach the float 710 for the unloading of materials which can then be moved partway up the ramp 704 by a winch aboard the supply vessel or by pedestal crane 26. The supplies can then be elevated onto the main deck 20 by the pedestal crane 26.

The pivotal connection 712 permits the floating ramp system 700 to rise and fall with tides and waves and to be usable for different operating water levels such as shown by water level W.L.-1 and W.L.-2 as illustrated. The entire floating ramp system 700 can be lifted upwardly by pedestal crane 26 and attached to the outer surface of depending skirt 90 or it can be detached from bracket 702 and returned to shore by a service vessel for storage during winter months.

Additional Features

It is usually desired to provide an impressed cathodic protection system for the exposed steel surfaces of structure 10. Such a system has been found preferable to the use of sacrificial anodes at arctic temperatures.

The composite concrete/steel ice walls 52 and 62 permit the concrete outer surfaces to be checked against cracking and in-service wear during relocation of structure 10 since these surfaces are not covered with a steel skin. This facilitates low cost in-service inspection.

The steel plating employed for the exterior surfaces such as skirt 70 and central column 80 and the outwardly flared support section 90 as well as the exposed main deck 20 can preferably be constructed of ABS GRADE EH-36 modified for a minimum ambient temperature of minus 50° F. Other steel internal plates and shapes of less than 20 millimeter thickess are constructed of ABS GRADE AH-36 steel, and plates and shapes of greater that 20 millimeter are constructed of DH-36 steel. The concrete utilized for ice walls 52, 54 and 62 contains hardrock aggregates and has an air dry weight of 150 pounds per cubic foot as hardened. The minimum 28 day compressive strength of this concrete is 7,000 p.s.i., and contains 6 to 8 percent air-entrapment. Concrete desities of from 100 to 180 pounds per cubic foot are usable.

It is preferable but not essential that the rebar mesh system 452 be epoxy coated.

The use of depending skirt patterns 194 on the undersurface of base 14 of structure 10 and of skirt pattern 544 on the bottom of berm 500 assures that any horizontal movement of the structure 10 or berm 500 will be due to shearing in the sea bottom soil rather than simply sliding of the structure over the sea floor.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. The process of installing a marine operations structure in a pre-determined sea floor location, said structure having a central core and a support base having at least two differently sloped ice wall surfaces for achieving fracturing of ice features, and having at least two series of circumferentially arranged ballast tanks, comprising the steps of:

positioning the structure over a selected sea floor location by the use of at least three tug boats connected to said structure by tension cables arranged radially with respect to said structure;

flooding a first series of lower ballast tanks in a sequential ballasting operation;

flooding a second series of ballast tanks located at a higher elevation within said structure than said first series of ballast tanks;

maintaining radial forces along said tension cables during said flooding steps; and after said structure has become founded on the bottom of the sea, pumping sea water into fluid tanks some of which are located at an elevation above the water level.

2. The process of installing a marine operations structure according to claim 1, wherein said flooding steps for each of said first and second series of ballast tanks is carried out in a diametrically opposite sequential pattern in each of the series of tanks.

3. The process of installing a marine operations structure according to claim 1, wherein said positioning step is carried out by positioning the three tug boats radially at angles of about 120° about the structure.

4. The process of installing a marine operations structure in a pre-determined sea location according to claim 1, wherein said positioning step is preceded by a towing step carried out by at least three tug boats which are connected to the structure by tension cables over a circumferential position described by an arc of at least 180° about the vertical centerline of said structure.

5. The process of installing a marine operations structure according to claim 1, wherein the tension cables utilized in said positioning step are connected to the structure at the level of the main deck.

6. The process of deballasting and refloating an installed marine operations structure from a given sea floor location, said structure having a central core and a support base having at least two differently sloped ice wall surfaces for achieving fracturing of ice features, and having at least a first and a second series of circumferentially arranged ballast tanks positioned at different vertical elevations, comprising the steps of:

dumping sea water from ballast tanks located at an elevation above the sea level;

deballasting said first series of ballast tanks which are located at a higher level within the marine operations structure than said second set of ballast tanks;

deballasting said second series of ballast tanks located at a lower elevation within the marine operations structure than said first series of ballast tanks; and prior to completion of the deballasting of said second series of ballast tanks, attaching tension cables between the marine structure and at least three tug boats.

7. The process of deballasting and refloating a marine operations structure according to claim 6, wherein said flooding steps for each of said first and second series of ballast tanks are carried out in a diametrically opposite sequential pattern in each of the series of tanks.

8. The process of deballasting and refloating a marine operations structure according to claim 6, wherein fluid jetting is applied to the bottom of said marine structure during the final stages of deballasting to loosen the structure from the sea floor.

9. The process of deballasting and refloating the marine operations structure according to claim 6, wherein the tension cables of said attaching step are radially positioned at angles of about 120° with respect to the structure.

10. The process of deballasting and refloating the marine operations structure according to claim 6, wherein the tension cables of said attaching step are radially positioned in an arc of at least 180° about the vertical centerline of said structure.

* * * * *